US007652432B2

(12) United States Patent
Hara et al.

(10) Patent No.: US 7,652,432 B2
(45) **Date of Patent: *Jan. 26, 2010**

(54) ORGANIC ELECTRO-LUMINESCENCE DEVICE, DRIVING METHOD THEREOF AND ELECTRONIC APPARATUS

(75) Inventors: Hiroyuki Hara, Chino (JP); Rie Makiura, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 501 days.

This patent is subject to a terminal disclaimer.

(21) Appl. No.: 11/354,098

(22) Filed: Feb. 15, 2006

(65) Prior Publication Data

US 2006/0208657 A1 Sep. 21, 2006

(30) Foreign Application Priority Data

Mar. 18, 2005 (JP) ..... 2005-080085

(51) Int. Cl.
*G09G 3/10* (2006.01)

(52) U.S. Cl. ..... 315/169.3; 345/76; 345/79

(58) Field of Classification Search ... 315/169.1–169.3; 313/504–506; 345/76, 77, 79, 102, 204
See application file for complete search history.

(56) References Cited

U.S. PATENT DOCUMENTS

| | | | | |
|---|---|---|---|---|
| 5,748,160 | A | 5/1998 | Shieh et al. | |
| 5,965,901 | A * | 10/1999 | Heeks et al. | 257/40 |
| 6,175,345 | B1 | 1/2001 | Kuribayashi et al. | |
| 6,366,025 | B1 * | 4/2002 | Yamada | 315/169.3 |
| 6,373,455 | B1 | 4/2002 | Kuribayashi et al. | |
| 6,583,581 | B2 * | 6/2003 | Kaneko et al. | 315/169.3 |
| 6,784,621 | B2 * | 8/2004 | Komoda et al. | 315/169.1 |
| 6,821,650 | B2 * | 11/2004 | Miyata et al. | 428/690 |
| 6,876,007 | B2 | 4/2005 | Yamazaki et al. | |
| 6,933,574 | B2 * | 8/2005 | Park et al. | 257/359 |
| 6,980,180 | B2 | 12/2005 | Hasagawa | |
| 6,998,789 | B2 | 2/2006 | Uchida | |
| 7,023,458 | B2 | 4/2006 | Kudo et al. | |
| 7,193,637 | B2 | 3/2007 | Kudo et al. | |
| 7,252,570 | B2 | 8/2007 | Takashima et al. | |
| 7,282,734 | B2 | 10/2007 | Yamazaki et al. | |
| 7,511,693 | B2 | 3/2009 | Kudo et al. | |
| 2003/0142509 | A1 | 7/2003 | Tsuchiya et al. | |

(Continued)

FOREIGN PATENT DOCUMENTS

| | | |
|---|---|---|
| JP | A-09-138659 | 5/1997 |

(Continued)

*Primary Examiner*—Douglas W Owens
*Assistant Examiner*—Jimmy T Vu
(74) *Attorney, Agent, or Firm*—Oliff & Berridge, PLC

(57) ABSTRACT

An organic electro-luminescence (EL) device including at least an emission layer between an anode and a cathode that are opposed to each other, including an anode buffer layer that is composed of an electrically conductive material and is provided between the anode and the emission layer, a cathode buffer layer that is composed of an electrically conductive material and is provided between the cathode and the emission layer, and a drive unit that applies a forward bias voltage and a reverse bias voltage that have opposite polarities to the anode and the cathode with setting application time periods of the forward bias voltage and the reverse bias voltage according to a luminance ratio of an image to be displayed.

19 Claims, 14 Drawing Sheets

U.S. PATENT DOCUMENTS

| | | | | |
|---|---|---|---|---|
| 2005/0030264 | A1 | 2/2005 | Tsuge et al. | |
| 2005/0041002 | A1 | 2/2005 | Takahara et al. | |
| 2005/0057580 | A1 | 3/2005 | Yamano et al. | |
| 2006/0192497 | A1* | 8/2006 | Hara et al. | 315/169.3 |
| 2007/0146251 | A1 | 6/2007 | Tsuge et al. | |
| 2008/0116788 | A1 | 5/2008 | Yamazaki et al. | |

FOREIGN PATENT DOCUMENTS

| | | | |
|---|---|---|---|
| JP | A 9-293588 | | 11/1997 |
| JP | A-11-003048 | | 1/1999 |
| JP | A-2002-215094 | | 7/2002 |
| JP | A 2002-297097 | | 10/2002 |
| JP | A-2002-366112 | | 12/2002 |
| JP | WO 03/023750 | A1 | 3/2003 |
| JP | A-2003-122305 | | 4/2003 |
| JP | WO 03/027998 | A1 | 4/2003 |
| JP | A-2003-150082 | | 5/2003 |
| JP | A-2003-157983 | | 5/2003 |
| JP | A-2003-195816 | | 7/2003 |
| JP | A-2003-228331 | | 8/2003 |
| JP | A-2003-255899 | | 9/2003 |
| JP | A 2004-114506 | | 4/2004 |
| JP | A-2004-170487 | | 6/2004 |
| JP | A-2004-247279 | | 9/2004 |
| JP | A-2005-004062 | | 1/2005 |

* cited by examiner

ORGANIC ELECTRO-LUMINESCENCE DEVICE, DRIVING METHOD THEREOF AND ELECTRONIC APPARATUS

BACKGROUND OF THE INVENTION

1. Technical Field

The present invention relates to an organic electro-luminescence (EL) device, a driving method thereof and an electronic apparatus.

2. Related Art

In recent years, increasing attention is being paid to organic EL devices employing organic EL elements as a self-luminous element requiring no backlight or the like. The organic EL display includes an organic EL layer, i.e., an emission layer between a pair of opposed electrodes. The organic EL element for full-color displaying includes emission layers that each have an emission wavelength band corresponding to a respective one of colors of red (R), green (G) and blue (B). Voltage application across the opposed electrodes induces recombination of injected electrons and holes in the emission layer, which leads to light emission by the light emitting element. The light emitting elements in the organic EL device are typically formed of thin films having a film thickness smaller than 1 μm. In addition, the organic EL display needs no backlight, which is used in liquid crystal displays, since the light emitting element itself emits light. The organic EL device therefore has an advantage of allowing an extremely small thickness thereof.

When the organic EL device is DC-driven by application thereto of a bias of one direction, impurity ions diffuse in the emission layer and are accumulated in a certain part. The accumulated impurity ions trap holes or electrons injected from the electrode, which problematically lowers the emission life and luminance. In order to address this problem, e.g. JP-A-9-293588 and JP-A-2004-114506 disclose an AC driving technique in which a forward bias voltage and a reverse bias voltage, which has the polarity opposite to that of the forward bias voltage, are alternately applied to the light emitting elements as a drive voltage for causing the light emitting elements to emit light. Since this AC driving alternately applies the voltages having the opposite polarities to the light emitting elements, the accumulation of charges and impurity ions in the light emitting elements and an internal electric field generated due to the impurity ions are alleviated. Thus, lowering of the emission life and luminance of the light emitting elements can be suppressed.

In cathode ray tube (CRT) displays, which are generally used as a display, peak-luminance displaying is performed in which the luminance of a luminescent area is enhanced if the ratio of the luminescent area to the entire display area is small. When an image of e.g. fireworks is displayed, black is displayed in almost the entire display area while displaying with an enhanced luminance is implemented in the small area corresponding to brilliance of the fireworks. Thus, the displayed image is allowed to have shape contrast. JP-A-2002-297097 discloses a technique in which an organic EL device implements peak-luminance displaying by changing voltages applied to organic EL elements depending on the ratio of a luminescent area to the entire display area.

However, in the above-described AC driving of light emitting elements, the light emitting elements emit light only when a positive voltage is applied to the anode thereof and a negative voltage is applied to the cathode thereof, i.e., only when a forward bias is applied to the light emitting elements since the light emitting elements typically have a multi-layered structure formed of an anode, an emission layer, and a cathode. That is, the light emitting elements do not emit light when a reverse bias is applied thereto in the AC driving. Therefore, the effective emission time periods are short, which leads to a problem of low brightness of displaying.

Furthermore, when it is aimed to achieve peak-luminance displaying by changing voltages applied to organic EL elements, there arises a need to provide individual power supplies that each correspond to a certain ratio of a luminance area to the entire display area. Accordingly, the size of an organic EL device is problematically increased. In contrast, a configuration employing a single variable power supply is also possible. However, use of such a power supply causes a problem that it is difficult to implement gray-scale control when the ratio of a luminescent area to the entire display area is large and therefore the drive voltage is low.

SUMMARY

An advantage of some aspects of the invention is to provide an organic EL device that can display images without shortening its effective emission time periods even when AC driving is implemented therefor to alternately apply forward and reverse biases to emission layers, and that can implement luminance control depending on the ratio of a luminescent area to the entire display area. An advantage of other aspects of the invention is to provide a method of driving an organic EL device, and an electronic apparatus including the organic EL device.

A first aspect of the invention provides an organic EL device including at least an emission layer between an anode and a cathode that are opposed to each other. The organic EL device includes an anode buffer layer that is composed of an electrically conductive material and is provided between the anode and the emission layer, a cathode buffer layer that is composed of an electrically conductive material and is provided between the cathode and the emission layer and a drive unit that applies a forward bias voltage and a reverse bias voltage that have opposite polarities to the anode and the cathode with setting application time periods of the forward bias voltage and the reverse bias voltage according to a luminance ratio of an image to be displayed.

According to the first aspect, since a structure that includes an anode buffer layer composed of a conductive material, an emission layer, and a cathode buffer layer composed of a conductive material is formed between an anode and a cathode, light emission is achieved invariably in response to both bias voltages that have opposite polarities and are applied alternately. This characteristic offers advantages of alleviating the accumulation of charges and impurity ions inside the emission layer and an internal electric field generated due to the impurity ions, and of allowing displaying without shortening effective emission time periods. In addition, the forward and reverse bias voltages having opposite polarities are applied to the anode and cathode while the application time periods thereof being set according to the luminance ratio of an image to be displayed. Therefore, e.g. such driving is allowed that the application time period of a forward bias voltage offering a high luminance is long when the luminance ratio of the image to be displayed is small, while the application time period of a reverse bias voltage offering a low luminance is long when the luminance ratio of the image to be displayed is large. Thus, luminance control in which displaying is appropriate for the luminance ratio can be carried out, which leads to an advantage of allowing situation-appropriate sharp displaying like CRT displays.

The term luminance ratio of an image to be displayed refers to the ratio between two integrated values of the luminances of emission layers. One is the value when all emission layers in the effective display region in an organic EL device emit light with the respective maximum luminances. The other is the value when only the emission layers that should be used for displaying based on the image to be displayed emit light for the displaying. Specifically, the luminance ratio Lr of an image to be displayed is expressed by Equation 1, where Lmax denotes the maximum luminance of each emission layer, and Lk (k denotes the number of emission layers that should emit light for displaying based on the image to be displayed) denotes the luminance of each emission layer when only the emission layers that should emit light for displaying based on the image to be displayed emit light for the displaying. The luminance ratio Lr is from 0 to 1.

$$Lr=\Sigma Lk/\Sigma L\max \quad \text{Equation 1}$$

In the organic EL device according to the first aspect, it is preferable that the drive unit applies each of the forward bias voltage and the reverse bias voltage to the anode and the cathode at least twice per a unit time period.

If each of the forward and reverse bias voltages is applied at least twice per a unit time period, recognition of flicker can be avoided even when the luminance obtained when the forward bias is applied is different from that when the reverse bias is applied.

In the organic EL device according to the first aspect, it is preferable that the unit time period is a time period during which one frame of the image is displayed.

If the application time periods of the forward and reverse bias voltages are set based on, as a unit time period, the time period it takes for one frame of an image to be displayed, luminance control according to the luminance ratio of an image to be displayed can be implemented without complicating the configuration of the drive unit.

In the organic EL device according to the first aspect, it is preferable that the drive unit applies first, in each unit time period, one of the forward bias voltage and the reverse bias voltage prior to the other thereof.

Alternatively, it is preferable that the drive unit applies first, in each unit time period, a bias voltage of which polarity is opposite to a polarity of a bias voltage applied last in the previous unit time period.

In the organic EL device according to the first aspect, it is preferable that the drive unit sets application time periods of the forward bias voltage and the reverse bias voltage so that emission luminance of the emission layer shows a nonlinear dependence on the luminance ratio of the image to be displayed.

If the application time periods of the forward and reverse bias voltages are set so that the emission luminance of emission layers shows a nonlinear dependence on the luminance ratio of an image to be displayed, situation-appropriate sharp displaying can be implemented naturally like CRT displays.

In the organic EL device according to the first aspect, it is preferable that the drive unit includes a table for defining application time periods of the forward bias voltage and the reverse bias voltage depending on the luminance ratio of the image to be displayed, the drive unit setting application time periods of the forward bias voltage and the reverse bias voltage based on the table.

If the application time periods of the forward and reverse bias voltages are set in accordance with information in the table, luminance control according to the luminance ratio of an image to be displayed can be implemented without complicating the device configuration and causing a rise of costs. Furthermore, the application time periods of forward and reverse bias voltages can be varied only by changing the information stored in the table, which avoids a need to greatly change the device configuration.

In the organic EL device according to the first aspect, it is preferable that the emission layer includes a red emission layer that emits red light, a green emission layer that emits green light, and a blue emission layer that emits blue light, and the drive unit sets application time periods of the forward bias voltage and the reverse bias voltage for each of the red emission layer, the green emission layer and the blue emission layer.

If the application time periods of the forward and reverse bias voltages are set for each of the red, green and blue emission layers separately, the emission luminances of the respective layers can advantageously be equalized even when there is a difference of the emission characteristic among the red, green and blue emission layers.

In the organic EL device according to the first aspect, it is preferable that the anode buffer layer and the cathode buffer layer are composed of an electrically conductive polymer.

In addition, it is preferable that the anode buffer layer and the cathode buffer layer are composed of a polymer compound including ethylenedioxythiophene.

The anode buffer layer and the cathode buffer layer may be composed of PEDOT/PSS.

Furthermore, it is preferable that a sheet resistance of the anode buffer layer and a sheet resistance of the cathode buffer layer are smaller than 100 Ωcm.

A second aspect of the invention provides a method of driving an EL device including at least an emission layer between an anode and a cathode that are opposed to each other. The method includes providing an anode buffer layer composed of an electrically conductive material between the anode and the emission layer, providing a cathode buffer layer composed of an electrically conductive material between the cathode and the emission layer, and applying a forward bias voltage and a reverse bias voltage that have opposite polarities to the anode and the cathode with setting application time periods of the forward bias voltage and the reverse bias voltage according to a luminance ratio of an image to be displayed.

According to the second aspect, since a structure that includes an anode buffer layer composed of a conductive material, an emission layer, and a cathode buffer layer composed of a conductive material is formed between an anode and a cathode, light emission is achieved invariably in response to both bias voltages that have opposite polarities and are applied alternately. This characteristic offers advantages of alleviating the accumulation of charges and impurity ions inside the emission layer and an internal electric field generated due to the impurity ions, and of allowing displaying without shortening effective emission time periods. In addition, the forward and reverse bias voltages having opposite polarities are applied to the anode and cathode while the application time periods thereof being set according to the luminance ratio of an image to be displayed. Therefore, e.g. such driving is allowed that the application time period of a forward bias voltage offering a high luminance is long when the luminance ratio of the image to be displayed is small, while the application time period of a reverse bias voltage offering a low luminance is long when the luminance ratio of the image to be displayed is large. Thus, luminance control in which displaying is appropriate for the luminance ratio can be carried out, which leads to an advantage of allowing situation-appropriate sharp displaying like CRT displays.

In the method of driving an organic EL device according to the second aspect, it is preferable that each of the forward bias voltage and the reverse bias voltage is applied to the anode and the cathode at least twice per a unit time period.

If each of the forward and reverse bias voltages is applied at least twice per a unit time period, recognition of flicker can be avoided even when the luminance obtained when the forward bias is applied is different from that when the reverse bias is applied.

In addition, it is preferable that the unit time period is a time period during which one frame of the image is displayed.

If the application time periods of the forward and reverse bias voltages are set based on, as a unit time period, the time period it takes for one frame of an image to be displayed, luminance control according to the luminance ratio of an image to be displayed can be implemented without complicating the configuration of the drive unit.

In the method of driving an organic EL device according to the second aspect, it is preferable that one of the forward bias voltage and the reverse bias voltage is applied first prior to the other thereof in each unit time period.

Alternatively, it is preferable that in each unit time period, a bias voltage is applied first of which polarity is opposite to a polarity of a bias voltage applied last in the previous unit time period.

In the method of driving an organic EL device according to the second aspect, it is preferable that application time periods of the forward bias voltage and the reverse bias voltage are set so that emission luminance of the emission layer shows a nonlinear dependence on the luminance ratio of the image to be displayed.

If the application time periods of the forward and reverse bias voltages are set so that the emission luminance of emission layers shows a nonlinear dependence on the luminance ratio of an image to be displayed, situation-appropriate sharp displaying can be implemented naturally like CRT displays.

In the method of driving an organic EL device according to the second aspect, it is preferable that application time periods of the forward bias voltage and the reverse bias voltage are set based on a table for defining application time periods of the forward bias voltage and the reverse bias voltage depending on the luminance ratio of the image to be displayed.

If the application time periods of the forward and reverse bias voltages are set in accordance with information in the table, luminance control according to the luminance ratio of an image to be displayed can be implemented without complicating the device configuration and causing a rise of costs. Furthermore, the application time periods of forward and reverse bias voltages can be varied only by changing the data stored in the table, which avoids a need to greatly change the device configuration.

In the method of driving an organic EL device according to the second aspect, it is preferable that the emission layer includes a red emission layer that emits red light, a green emission layer that emits green light, and a blue emission layer that emits blue light, and application time periods of the forward bias voltage and the reverse bias voltage are set for each of the red emission layer, the green emission layer and the blue emission layer.

If the application time periods of the forward and reverse bias voltages are set for each of the red, green and blue emission layers separately, the emission luminances of the respective layers can advantageously be equalized even when there is a difference of the emission characteristic among the red, green and blue emission layers.

An electronic apparatus according to a third aspect of the invention includes the organic EL device according to the first aspect.

According to the third aspect, an electronic apparatus having a favorable displaying characteristic can be provided.

BRIEF DESCRIPTION OF THE DRAWINGS

The invention will be described with reference to the accompanying drawings, wherein like numbers refer to like elements.

DESCRIPTION OF EXEMPLARY EMBODIMENTS

Figure 1:
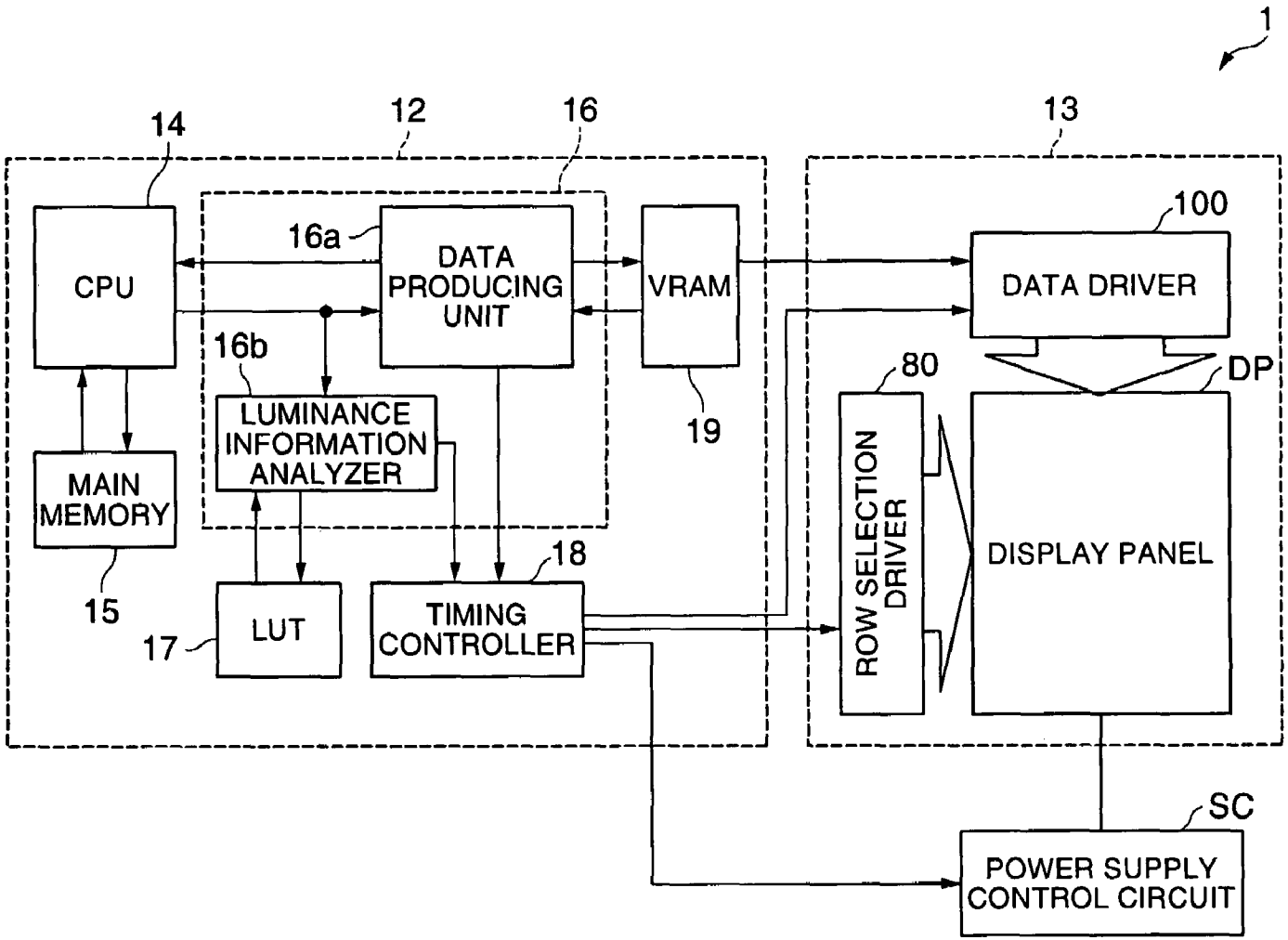
FIG. 1 is a block diagram illustrating the electrical configuration of an organic EL device according to one embodiment of the invention.

Organic EL devices according to embodiments of the invention, a driving method thereof, and an electronic apparatus will be described below with reference to the accompanying drawings. It should be noted that the following embodiments only show part of aspects of the invention. It should also be noted that the embodiments do not limit the invention but can optionally be changed within the technical idea of the invention. In the following drawings, different scale is used for each layer and each member in order to illustrate the layers and members with a recognizable size in the drawings.

FIG. 1 is a block diagram illustrating the electrical configuration of an organic EL device according to one embodiment of the invention. Referring to FIG. 1, an organic EL device 1 of the present embodiment includes a peripheral drive device 12 and a display panel unit 13. The peripheral drive device 12 includes a central processing unit (CPU) 14, a main memory 15, a graphic controller 16, a lookup table (LUT) 17, a timing controller 18, and a video RAM (VRAM) 19. A micro processing unit (MPU) may be included instead of the CPU 14. The display panel unit 13 includes a display panel DP, a row selection driver 80, and a data driver 100. The display panel DP provided in the display panel unit 13 is supplied with a voltage from a power supply control circuit SC.

The CPU 14 in the peripheral drive device 12 retrieves image data stored in the main memory 15, and performs various kinds of processing such as development processing with use of the main memory 15, and then outputs the processed data to the graphic controller 16. The graphic controller 16 includes a data producing unit 16*a* and a luminance information analyzer 16*b*. The data producing unit 16*a* produces image data and synchronization signals (vertical synchronization signal and horizontal synchronization signal) for the display panel unit 13 based on the image data output from the CPU 14. The graphic controller 16 transfers the image data produced by the data producing unit 16*a* to the VRAM 19, and outputs the synchronization signals to the timing controller 18.

The luminance information analyzer 16*b* of the graphic controller 16 calculates the luminance ratio of image data based on the image data output from the CPU 14. The term luminance ratio of image data refers to the ratio between two integrated values of the luminances of pixels (details of the pixels will be described later). One is the value when all the pixels in the display panel DP emit light with the respective maximum luminances. The other is the value when only the pixels that should be used for displaying based on the image data emit light for the displaying.

Specifically, the luminance ratio Lr of image data is expressed by Equation 2, where Lmax denotes the maximum luminance of each pixel, and Lk (k denotes the number of pixels that should emit light for displaying based on the image data) denotes the luminance of each pixel when only the pixels that should emit light for displaying based on the image data emit light for the displaying. The luminance ratio Lr is from 0 to 1.

$$Lr=\Sigma Lk/\Sigma L\max \qquad \text{Equation 2}$$

When all the pixels in the display panel DP emit light with the maximum luminances, i.e., when the luminance ratio Lr of image data is 1, the display panel DP, displays the brightest white. As the luminance ratio Lr of image data approaches 1, the number of pixels emitting light is increased and the luminescent area is enlarged. Therefore, the entire display panel DP approaches white. In contrast, as the luminance ratio Lr of image data approaches 0, the number of pixels emitting light is decreased and the luminescent area is reduced. Therefore, the entire display panel DP approaches black.

The luminance information analyzer 16*b* determines the ratio (duty ratio) between application time periods of a forward bias and a reverse bias that are supplied from the power supply control circuit SC to the display panel DP, based on the calculated luminance ratio of image data and information stored in the LUT 17. Details of the forward and reverse biases will be described later. The graphic controller 16 outputs to the timing controller 18 the duty ratio determined by the luminance information analyzer 16*b* as well as the above-described synchronization signals. The LUT 17 stores data that defines application time periods of forward and reverse biases associated with the luminance ratios of image data. Details about determination of the duty ratio based on the data stored in the LUT 17 will be described later.

The VRAM 19 outputs the image data supplied from the graphic controller 16 to the data driver 100 in the display panel unit 13. The timing controller 18 outputs the horizontal synchronization signals to the data driver 100 in the display panel unit 13, and outputs the vertical synchronization signals to the row selection driver 80 in the display panel unit 13. In addition, the timing controller 18 outputs to the power supply control circuit SC a control signal for switch-over between the forward and reverse biases. The image data from the VRAM 19 and various signals from the timing controller 18 are output in sync with each other.

Figure 2:
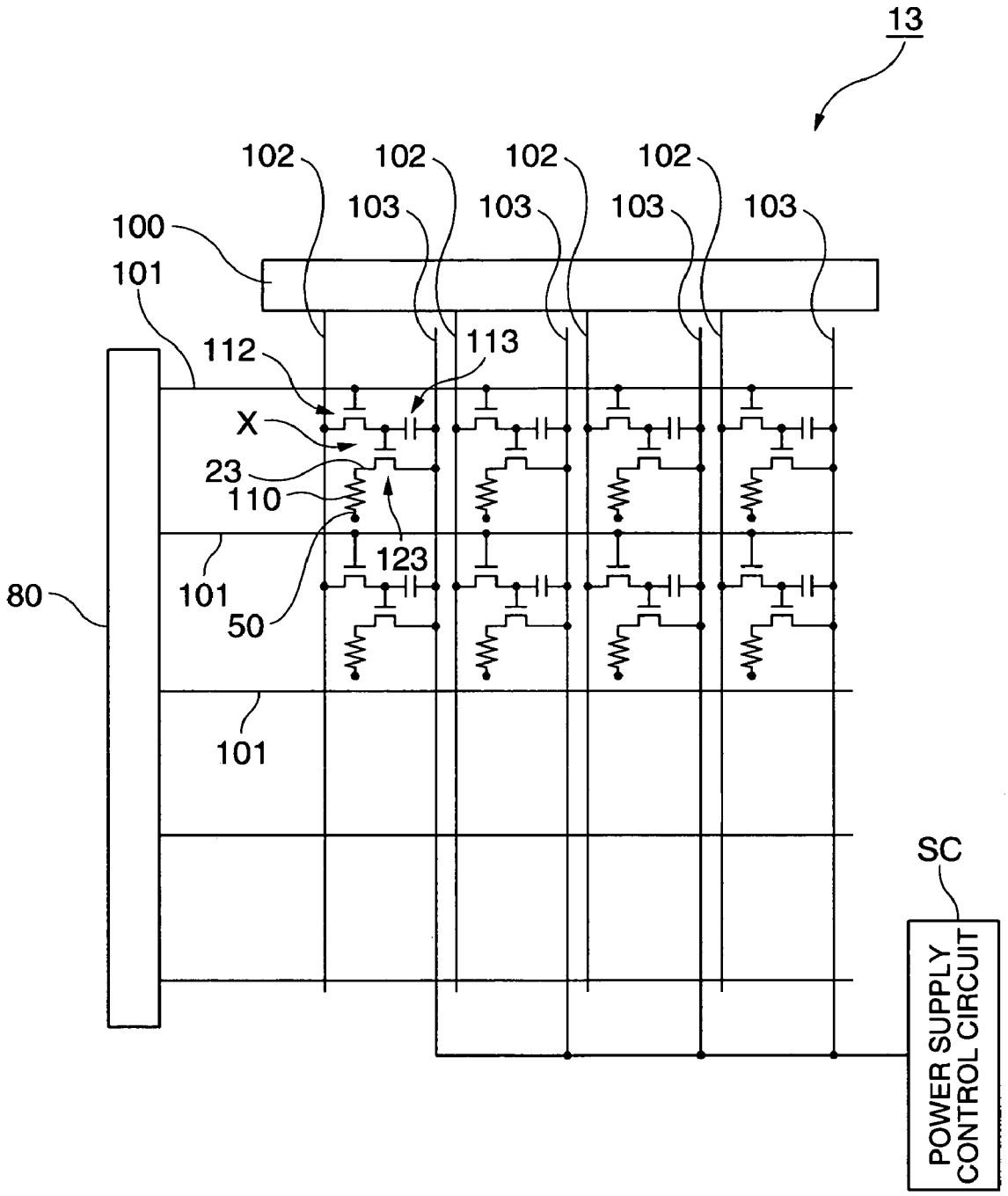
FIG. 2 is a schematic diagram illustrating the interconnect configuration of a display panel unit 13 provided in an organic EL device according to one embodiment of the invention.

The configuration of the display panel unit 13 will be described below. FIG. 2 is a schematic diagram illustrating the interconnect configuration of the display panel unit 13 provided in an organic EL device according to one embodiment of the invention. The display panel unit 13 in FIG. 2 includes an active matrix display that employs thin-film transistors (TFT) as its switching elements. The display panel unit 13 has an interconnect configuration formed of a plurality of scan lines 101, a plurality of signal lines 102 extending in the direction perpendicularly crossing the scan lines 101, and a plurality of power supply lines 103 extending in parallel with the signal lines 102. Furthermore, a pixel region X is formed near each intersection between the scan line 101 and the signal line 102.

The display panel unit 13 provided in the organic EL device 1 of the present embodiment has a so-called vertical stripe configuration. Specifically, along the signal lines 102 and the power supply lines 103, luminescent regions of the same color are arranged. Along the scan lines 101, red, green and blue luminescent regions are in turn arranged repeatedly. Each power supply line 103 is coupled to the power supply control circuit SC. Coupled to the signal lines 102 is the data driver 100 that includes a shift register, a level shifter, a video line, and an analog switch. Coupled to the scan lines 101 is the row selection driver 80 that includes a shift register and a level shifter.

Each pixel region X includes a switching TFT 112 of which gate electrode is supplied with a scan signal via the scan line 101, a hold capacitor 113 that holds a pixel signal supplied from the signal line 102 via the switching TFT 112, and a drive TFT 123 of which gate electrode is supplied with the pixel signal held by the hold capacitor 113. In addition, each pixel region X also includes a pixel electrode (electrode) 23, and a functional layer 110 interposed between the pixel electrode 23 and a common cathode (electrode) 50. A drive current flows from the power supply line 103 into the pixel electrode 23 when the pixel electrode 23 is electrically coupled via the drive TFT 123 to the power supply line 103. The pixel electrode 23, the common cathode 50, and the functional layer 110 provide a light emitting element, i.e. an organic EL element.

In the display panel unit 13, when the scan line 101 is driven and thus the switching TFT 112 is turned on, the potential at the signal line 102 when the TFT 112 is turned on is held by the hold capacitor 113, and the state of the hold capacitor 113 determines on/off of the drive TFT 123. Subsequently, a current flows from the power supply line 103 through the channel of the drive TFT 123 into the pixel electrode 23. The current further flows through the functional layer 110 into the common cathode 50. The functional layer 110 emits light according to the amount of the current flowing therethrough.

Figure 3:
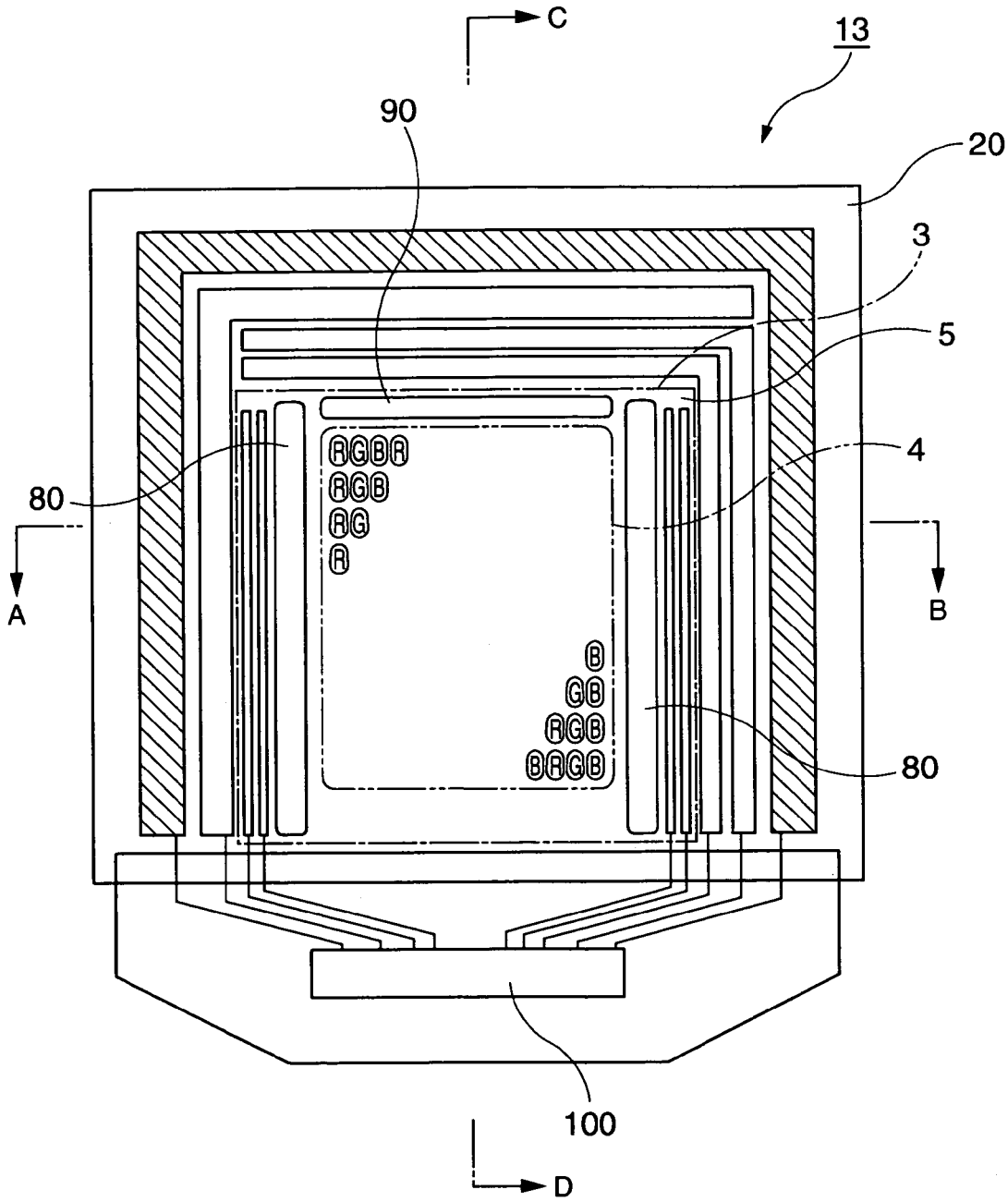
FIG. 3 is a plan view schematically illustrating the configuration of the display panel unit 13 provided in an organic EL device 1 according to one embodiment of the invention.

FIG. 3 is a plan view schematically illustrating the configuration of the display panel unit 13 provided in the organic EL device 1 according to one embodiment of the invention. Referring to FIG. 3, the display panel unit 13 includes a substrate 20 having optical transparency and electrical insulation, and a pixel electrode region (not shown) obtained by arranging pixel electrodes coupled to the switching TFTs (not shown) in a matrix on the substrate 20. The display panel unit 13 also includes the power supply lines 103 that are disposed in the periphery of the pixel electrode region and are coupled to the pixel electrodes, and a pixel part 3, surrounded by the chain line in FIG. 3, that is located at least over the pixel electrode region and has an almost rectangular shape in plan view. In the present embodiment, the pixel part 3 is subdivided into a central effective display region 4 surrounded by the chain double-dashed line in FIG. 3, and a dummy region 5, between the chain line and chain double-dashed line, disposed in the periphery of the effective display region 4.

In the effective display region 4, display regions R, G and B each including a pixel electrode are regularly arranged along the direction A-B and along the direction C-D in FIG. 3. In addition, the row selection drivers 80 are disposed on the both sides, in FIG. 3, of the effective display region 4. The row selection drivers 80 are provided under the dummy region 5. Furthermore, a test circuit 90 is disposed on the upside, in FIG. 3, of the effective display region 4, and is provided under the dummy region 5. The test circuit 90 is a circuit for testing the operational state of the organic EL device 1. The test circuit 90 includes e.g. a test information output unit (not shown) that outputs test results to the external, and can test the quality and the presence of defects of displays in the middle of manufacturing and at the time of shipping.

Figure 4:
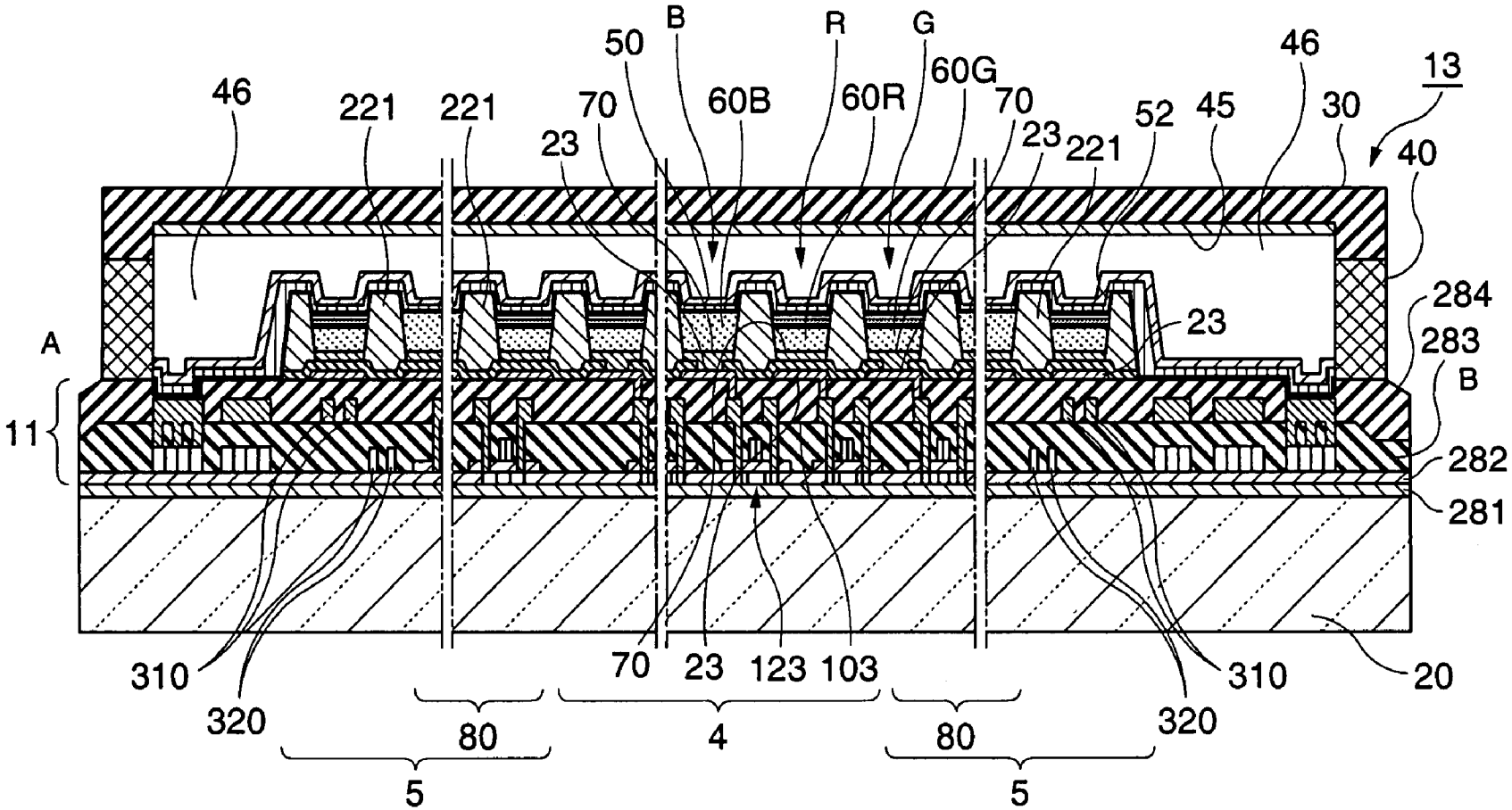
FIG. 4 is a sectional view along the line A-B in FIG. 3.
Figure 5:
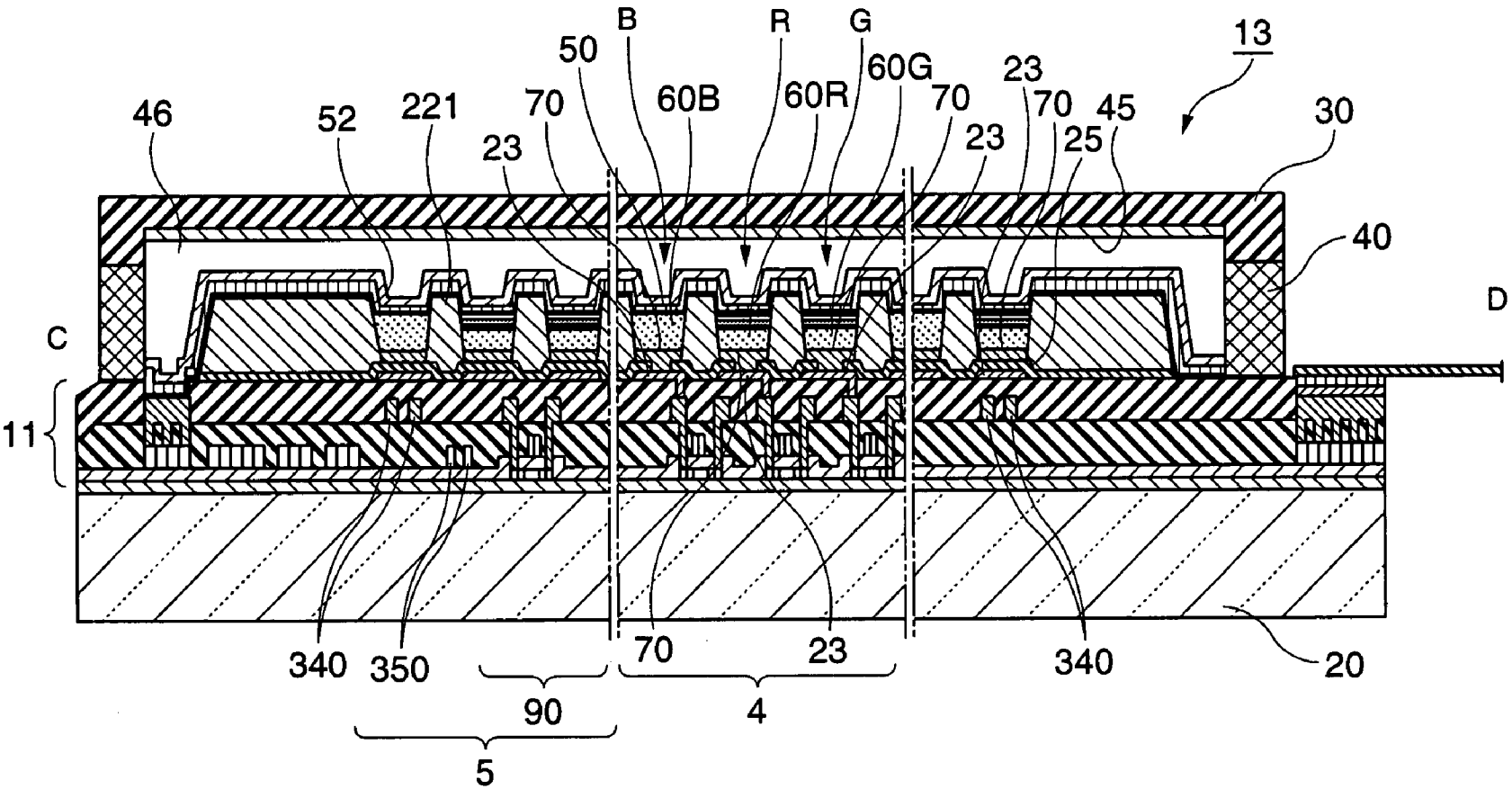
FIG. 5 is a sectional view along the line C-D in FIG. 3.

A drive voltage is applied from a certain power supply unit to the row selection drivers 80 and the test circuit 90 via drive voltage conductors 310 (see FIG. 4) and drive voltage conductors 340 (see FIG. 5). Furthermore, a drive control signal and a drive voltage are transmitted and applied to the row selection drivers 80 and the test circuit 90 from a certain main driver or the like that controls the operation of the organic EL device 1 via drive control signal conductors 320 (see FIG. 4) and drive voltage conductors 350 (see FIG. 5). The term drive control signal refers to a command signal from the main driver or the like, associated with controlling the signal output from the row selection drivers 80 and the test circuit 90.

FIG. 4 is a sectional view along the line A-B in FIG. 3. FIG. 5 is a sectional view along the line C-D in FIG. 5. As shown in FIGS. 4 and 5, the display panel unit 13 is formed by attaching the substrate 20 to a sealing substrate 30 with the intermediary of sealing resin 40 therebetween. In the space surrounded by the substrate 20, the sealing substrate 30, and the sealing resin 40, a getter agent 45 absorbing water and oxygen is attached to the inner surface of the sealing substrate 30. The space is filled with a nitrogen gas, and thus serves as a nitrogen gas filled layer 46. This structure suppresses penetration of water and oxygen into the inside of the display panel unit 13, which elongates the life of the organic EL device 1.

When the organic EL device 1 is a so-called top-emission organic EL device, emitted light is obtained through the sealing substrate 30, which is opposite to the substrate 20. Therefore, either of transparent and opaque substrates can be used as the substrate 20. Examples of materials of the opaque substrate include ceramic such as alumina, a metal sheet made of e.g. stainless steel for which insulating treatment such as surface oxidization has been implemented, a thermo-setting resin, and a thermo-plastic resin.

When the organic EL device 1 is a so-called bottom-emission organic EL device, a transparent or semi-transparent substrate is used as the substrate 20 since emitted light is obtained through the substrate 20. Examples of materials of the transparent or semi-transparent substrate include glass, quartz, and resin (plastic and plastic films). A glass substrate is preferably used in particular. The present embodiment employs a bottom-emission device offering emitted light through the substrate 20, and therefore uses a transparent or semi-transparent substrate as the substrate 20. As the sealing substrate 30, e.g. an electrically insulating plate member can be used. The sealing resin 40 is composed of e.g. thermo-setting resin or UV curable resin. In particular, it is preferable that it is composed of epoxy resin, which is one kind of the thermo-setting resin.

Figure 6:
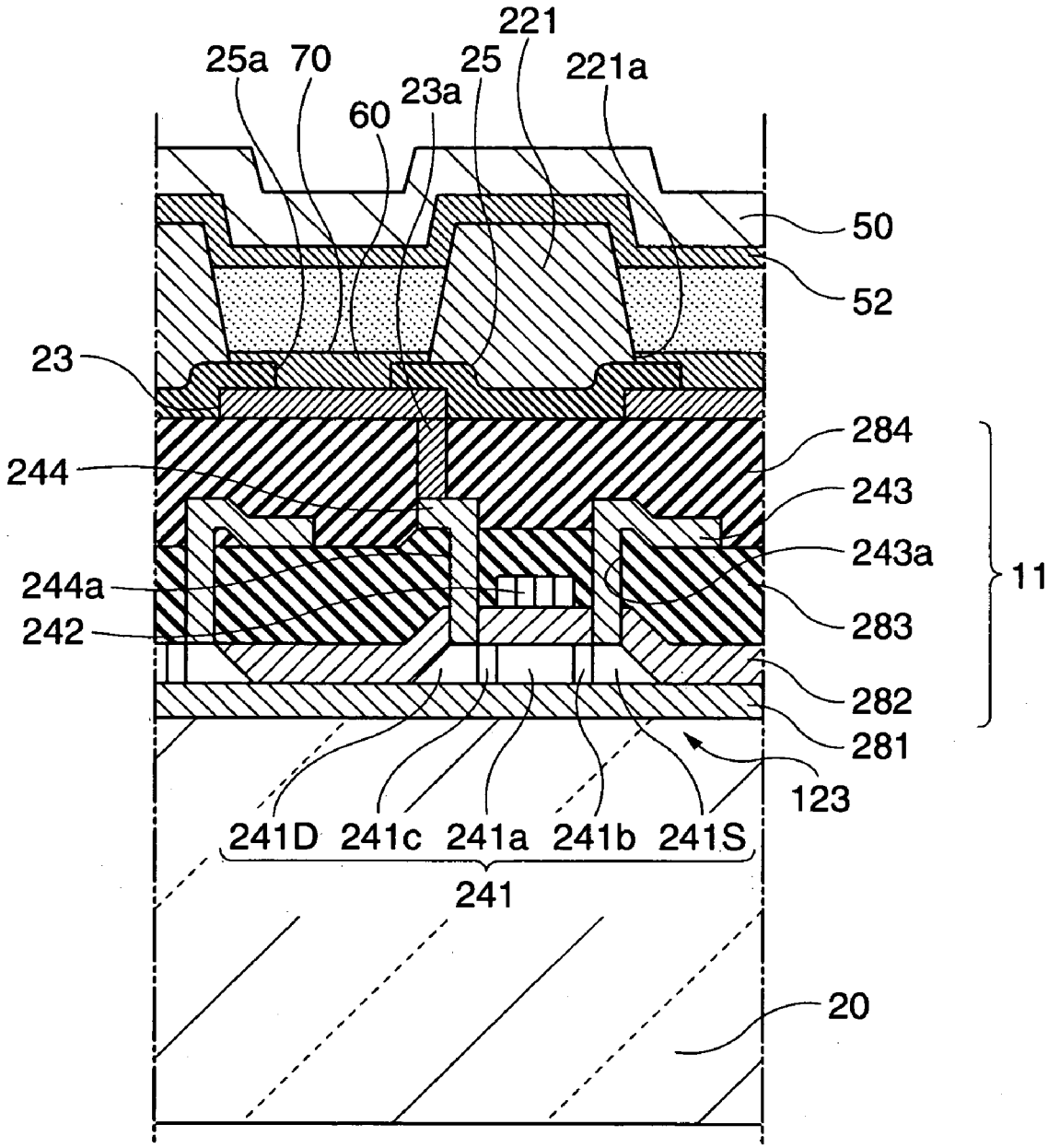
FIG. 6 is an enlarged view of a circuit part 11 including drive TFTs 123 and so forth.

Formed on the substrate 20 is a circuit part 11 that includes the drive TFTs 123 for driving the pixel electrodes 23, and so forth. FIG. 6 is an enlarged view of the circuit part 11 including the drive TFTs 123 and so forth. Formed on the surface of the substrate 20 is a base protective layer 281 composed mainly of SiO2, and a silicon layer 241 is formed on the base protective layer 281. A gate insulating layer 282 composed mainly of SiO2 and/or SiN is formed on the surface of the silicon layer 241.

The region, in the silicon layer 241, over which a gate electrode 242 is disposed with the gate insulating layer 282 therebetween serves as a channel region 241*a*. The gate electrode 242 is part of the scan line 101 (not shown). A first interlayer insulating layer 283 composed mainly of SiO2 is formed on the surface of the gate insulating layer 282, which covers the silicon layer 241, and on which the gate electrode 242 is formed.

In the silicon layer 241, a lightly-doped source region 241*b* and a heavily-doped source region 241S are provided in a region, adjacent to the channel region 241*a*, on the source side. In addition, a lightly-doped drain region 241*c* and a heavily-doped drain region 241D are provided in a region, adjacent to the channel region 241*a*, on the drain side. Thus, a so-called lightly doped drain (LDD) structure is achieved. Of these regions, the heavily-doped source region 241S is coupled to a source electrode 243 via a contact hole 243*a* that is formed through the gate insulating layer 282 and the first interlayer insulating layer 283. The source electrode 243 is part of the power supply line 103 (see FIG. 2). In FIG. 6, the power supply line 103 extends in the direction perpendicular to the drawing plane, with crossing the position of the source electrode 243. Furthermore, the heavily-doped drain region 241D is coupled to a drain electrode 244 formed of the same layer as that of the source electrode 243 via a contact hole 244*a* that is formed through the gate insulating layer 282 and the first interlayer insulating layer 283.

A second interlayer insulating layer 284 composed mainly of e.g. an acrylic resin component covers the top surface of the first interlayer insulating layer 283, on which the source and drain electrodes 243 and 244 are formed. Instead of an acrylic insulating film, e.g. SiN, or SiO2 may be used for the second interlayer insulating layer 284. In addition, the pixel electrode 23 made of ITO is formed on the surface of the second interlayer insulating layer 284, and is coupled to the drain electrode 244 via a contact hole 23*a* provided in the second interlayer insulating layer 284. That is, the pixel electrode 23 is coupled via the drain electrode 244 to the heavily-doped drain region 241D in the silicon layer 241.

The circuit part 11 is formed of the elements described above from the base protective film 281 on the substrate 20 to the second interlayer insulating layer 284. TFTs (TFTs for drive circuits) included in the row selection drivers 80 and the test circuit 90, i.e., N- or P-channel TFTs included in inverters in shift registers of these drive circuits for example, have the same structure as that of the drive TFTs 123 except that they are not coupled to the pixel electrodes 23.

The surface of the second interlayer insulating layer 284, on which the pixel electrodes 23 are formed, is covered with the pixel electrodes 23, lyophilic control layers 25 composed mainly of a lyophilic material such as SiO2, organic bank layers 221 made of an acrylic material, polyimide or the like. The term lyophilic of the lyophilic control layer 25 in the present embodiment means that the layer 25 has higher lyophilicity at least compared with the material of the organic bank layer 221, such as an acrylic material or polyimide. Each pixel region is formed of the inside region of an opening 25*a* provided in the lyophilic control layer 25 and the inside region of an opening 221*a* provided in the organic bank layer 221. At each boundary between color display regions (pixel regions), a black matrix (BM) (not shown) formed by depositing metal chromium by sputtering or the like is provided between the organic bank layer 221 and the lyophilic control layer 25.

In each pixel region, a corresponding one of the light emitting elements (organic EL elements) R, G and B is provided. Each of the light emitting elements R, G and B is formed by depositing the pixel electrode 23 serving as an anode, an anode buffer layer 70, an emission layer 60 (60R, 60G or 60B) composed of an organic EL substance, a cathode buffer layer 52, and the common cathode 50 in that order. When a forward bias is applied to the light emitting element R, G, or B, holes injected from the anode buffer layer 70 recombine with electrons injected from the cathode buffer layer 52 in the emission layer 60, and thus light of red, green or blue is emitted. When a reverse bias is applied thereto, electrons injected from the anode buffer layer 70 recombine with holes injected from the cathode buffer layer 52 in the emission layer 60, and thus light of red, green or blue is emitted.

The pixel electrode 23 serving as an anode is formed of a transparent conductive material since the present embodiment employs a bottom-emission device. ITO is preferable as the transparent conductive material. Instead of ITO, however, the pixel electrode 23 may be made of e.g. an indium oxide-zinc oxide amorphous transparent conductive film (indium zinc oxide (IZO, registered trademark, produced by Idemitsu Kosan Co., Ltd.)). Note that the present embodiment employs ITO. When a top-emission device is employed, an optically transparent material does not need to be used, and an aluminum (Al) film or the like may be provided under ITO as a reflection layer for example.

As the material for forming the anode buffer layer 70, a solution is preferably used in particular that is prepared by forming a dispersion liquid of 3,4-polyethylenedioxythiophene/polystyrene sulfonate (PEDOT/PSS) by dispersing 3,4-polyethylenedioxythiophene in polystyrene sulfonate as a dispersion medium, and then dissolving the dispersion liquid in a polar solvent such as water or isopropyl alcohol. It is preferable that the sheet resistance of the anode buffer layer 70 is smaller than 100 Ωcm. In the present embodiment, the anode buffer layer 70 having a sheet resistance of 0.1 Ωcm or less is preferably used.

As the material for forming the emission layer 60, a publicly known luminescent material capable of emitting fluorescence or phosphorescence is used. In addition, in the present embodiment, the emission layers 60 are formed so that the emission wavelength bands thereof correspond to three primary colors of light, in order to allow full-color displaying. Specifically, one pixel is formed of three emission layers: the emission layer 60R of which emission wavelength band corresponds to red, the emission layer 60G corresponding to green, and the emission layer 60B corresponding to blue. These emission layers each emit gray-scale light, which allows the entire organic EL display 1 to achieve full-color displaying.

As the forming material of the emission layer 60, specifically any of the following materials can preferably be used: a (poly) fluorene derivative (PF), a (poly) p-phenylenevinylene derivative (PPV), a polyphenylene derivative (PP), a poly-p-phenylene derivative (PPP), polyvinylcarbazole (PVK), a polythiophene derivative, and a polysilane material such as polymethylphenylsilane (PMPS). Furthermore, these polymer materials may be doped with another polymer material such as a perylene dye, coumarin dye or rhodamine dye, or a low-molecular-weight material such as rubrene, perylene, 9,10-diphenylanthracene, tetraphenylbutadiene, nile red, coumarin 6 or quinacridone. The term polymer refers to a polymer of which molecular weight is larger than that of a so-called low-molecular-weight material having a molecular weight of about several hundreds. The above-described polymer material encompasses both polymers typically called a high-molecular-weight material, having a molecular weight of 10000 or larger, and lower polymers called an oligomer, having a molecular weight of 10000 or smaller.

In the present embodiment, MEHPPV (poly 3-methoxy 6-(3-ethylhexyl) p-phenylenevinylene) is used as the forming material of the red emission layer 60R. A solution of a blend of polydioctylfluorene and F8BT (an alternating copolymer of dioctylfluorene and benzothiadiazole) is used as the forming material of the green emission layer 60G. Polydioctylfluorene is used as the forming material of the blue emission layer 60B. There is no particular limitation on the thickness of each emission layer 60, and the preferable thickness is different for each color. For example, as for the blue emission layer 60B, a thickness of about 60-70 nm is preferable.

As the material for forming the cathode buffer layer 52, similarly to the anode buffer layer 70, a solution is preferably used in particular that is prepared by forming a dispersion liquid of 3,4-polyethylenedioxythiophene/polystyrene sulfonate (PEDOT/PSS) by dispersing 3,4-polyethylenedioxythiophene into polystyrene sulfonate as a dispersion medium, and then dissolving the dispersion liquid in a polar solvent such as water or isopropyl alcohol. It is preferable that the sheet resistance of the cathode buffer layer 52 is smaller than 100 Ωcm. In the present embodiment, the cathode buffer layer 52 having a sheet resistance of 0.1 Ωcm or less is preferably used.

As shown in FIGS. 4 to 6, the common cathode 50 is formed so as to have an area larger than the total area of the effective display region 4 and the dummy region 5, and cover the respective regions. Any material may be used for the common cathode 50 without particular limitation as long as it is a chemically stable conductive material. For example, a metal or alloy can be used, and specifically aluminum is preferably used. The common cathode 50 preferably has a thickness of about 100-500 nm, and more preferably has a thickness of about 200 nm in particular. A thickness under 100 nm possibly does not offer a sufficient protective function. In contrast, a thickness above 500 nm possibly increases the thermal load during fabrication, and thus has adverse effects on the emission layer 60, such as deterioration and transformation. The present embodiment uses gold to form the common cathode 50. When manufacturing a top-emission organic EL device, a sufficiently thin common cathode 50 can be formed so that it has transparency, or alternatively a transparent conductive material such as ITO can be used to form the common cathode 50.

In the organic EL device 1 with the above-described configuration, when voltages having opposite polarities are alternately applied to a light emitting element, the anode buffer layer and cathode buffer layer allow the light emitting element to always emit light in response to both the voltages. This AC driving alleviates the accumulation of charges and impurity ions inside the light emitting element and an internal electric field generated due to the impurity ions. Furthermore, the light emission in response to both the voltages allows displaying without shortening effective emission time periods.

Figure 7:
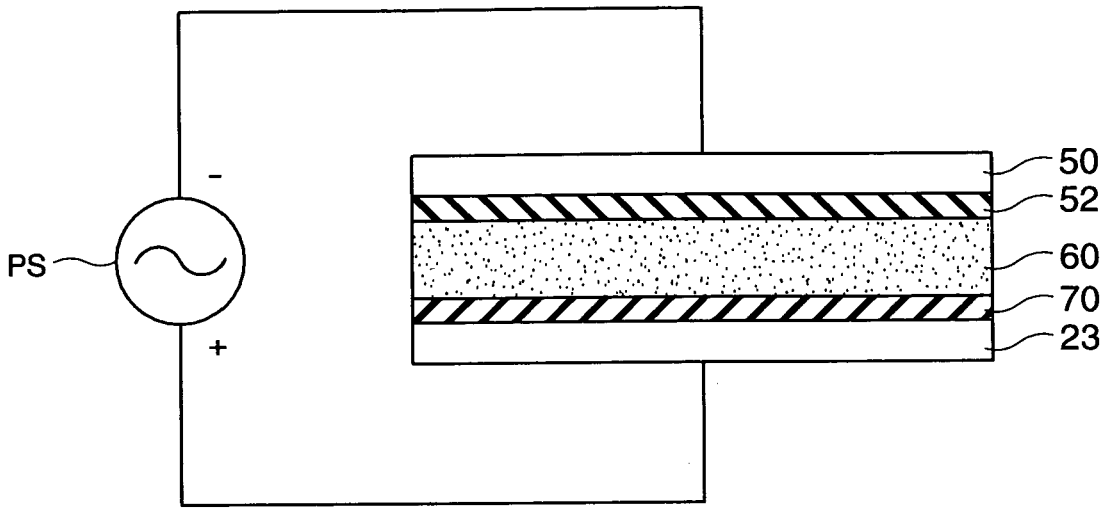
FIG. 7 is a diagram schematically illustrating the driving system for one light emitting element.

FIG. 7 is a diagram schematically illustrating the driving system for one light emitting element. Referring to FIG. 7, the light emitting element is formed of the pixel electrode 23, the anode buffer layer 70, the emission layer 60, the cathode buffer layer 52, and the common cathode 50. The pixel electrode 23 is coupled to the positive electrode of an AC power supply PS, while the common cathode 50 is coupled to the negative electrode of the AC power supply PS. The AC power supply PS is equivalent to the power supply control circuit SC in FIG. 2. As described above, the organic EL device 1 of the present embodiment can provide light emission both when a bias applied across the pixel electrode 23 and the common cathode 50 is a forward bias and when the bias is a reverse bias. However, the emission characteristic thereof is different between when a forward bias is applied and when a reverse bias is applied.

Figure 8:
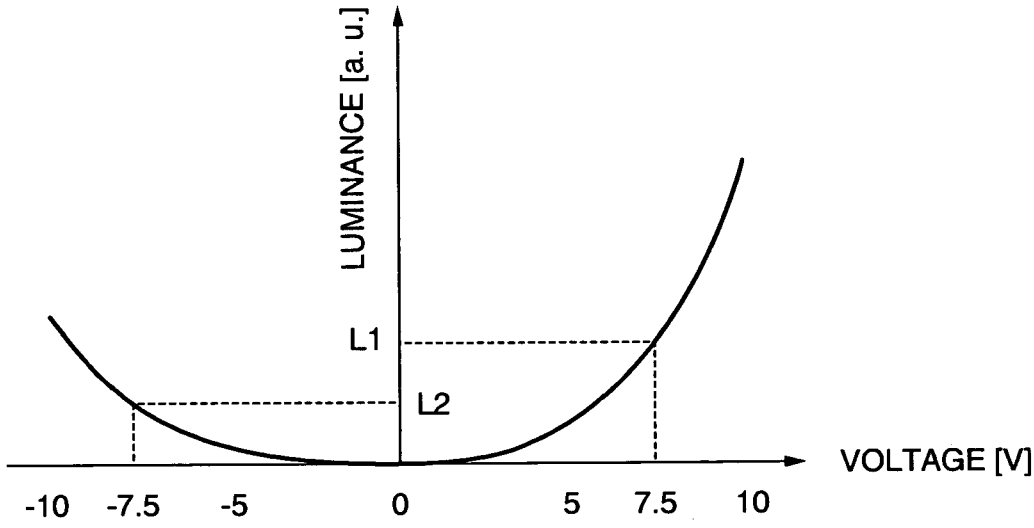
FIG. 8 is a diagram illustrating one example of the emission characteristic of a light emitting element provided in the organic EL device 1 of one embodiment.

FIG. 8 is a diagram illustrating one example of the emission characteristic of a light emitting element provided in the organic EL device 1 of the present embodiment. In the graph of FIG. 8, voltages applied across the pixel electrode 23 and the common cathode 50 in the light emitting element are plotted on the abscissa, and emission luminances of the light emitting element are plotted on the ordinate. As shown in FIG. 8, when a forward bias is applied (corresponding to the positive side of the abscissa in FIG. 8), a luminance is gradually increased as a voltage is increased. When a reverse bias is applied (corresponding to the negative side of the abscissa in FIG. 8), a luminance is gradually increased as the absolute value of a voltage is increased. This graph shows that light is emitted both when a forward bias is applied and when a reverse bias is applied.

However, the emission luminance obtained when a certain forward bias is applied is different from that obtained when the reverse bias having the same absolute value as that of the certain forward bias is applied. For example, a luminance L1 obtained when a voltage of +7.5 V is applied as a forward bias is larger than a luminance L2 obtained when a voltage of −7.5 V is applied as a reverse bias. The present embodiment utilizes this characteristic. Specifically, the duty ratio between the application time periods of forward and reverse biases is changed depending on the luminance ratio of image data, to thereby implement luminance control according to the luminance ratio.

Figure 9:
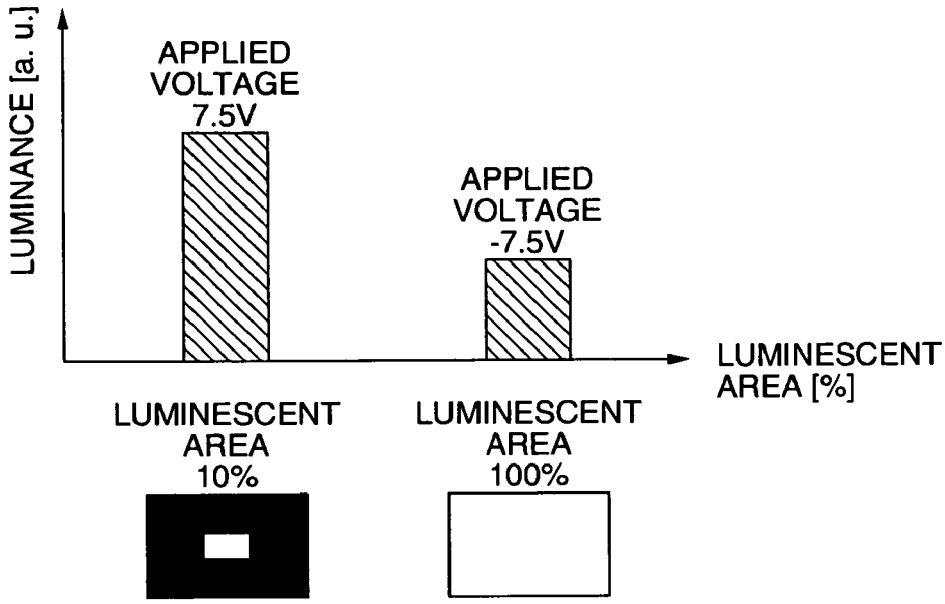
FIG. 9 is a diagram for explaining a basic principle of a method of driving an organic EL device according to one embodiment of the invention.

FIG. 9 is a diagram for explaining a basic principle of a method of driving an organic EL device according to one embodiment of the invention. In the graph of FIG. 9, luminescent areas of a light emitting element are plotted on the abscissa, while emission luminances of the light emitting element are plotted on the ordinate. In addition, FIG. 9 schematically illustrates the relationship between the effective display region 4 and the luminescent area when the luminescent area is 10%, and that when it is 100%. As shown in FIG. 9, when the luminescent area is 10%, only a center part of the effective display region 4 displays white, while the other large part displays black. In contrast, when the luminescent area is 100%, the entire effective display region 4 displays white. Note that the luminescent area relative to the effective display region 4 is equivalent to the above-described luminance ratio in this embodiment. However, if the light emitting element has a intermediate luminance, the luminance is controlled according to a luminance ratio of the light emitting element.

In the present embodiment, basically, a reverse bias, which offers a lower luminance, is applied to a light emitting element when the luminescent area is large. In addition, a forward bias, which offers a higher luminance, is applied to a light emitting element when the luminescent area is small. In the example of FIG. 9, a voltage of 7.5 V is applied as a forward bias when the luminescent area is 10%, while a voltage of −7.5 V is applied as a reverse bias when the luminescent area is 100%. On the premise of defining application time periods of forward and reverse biases as T1 and T2, respectively, and defining the ratio between these application time periods (duty ratio) as T1/(T1+T2), the subsequent description employs the following conditions for simplification: the duty ratio when the luminescent area is 10% is 100%, and the duty ratio when the luminescent area is 100% is 0%.

Figure 10:
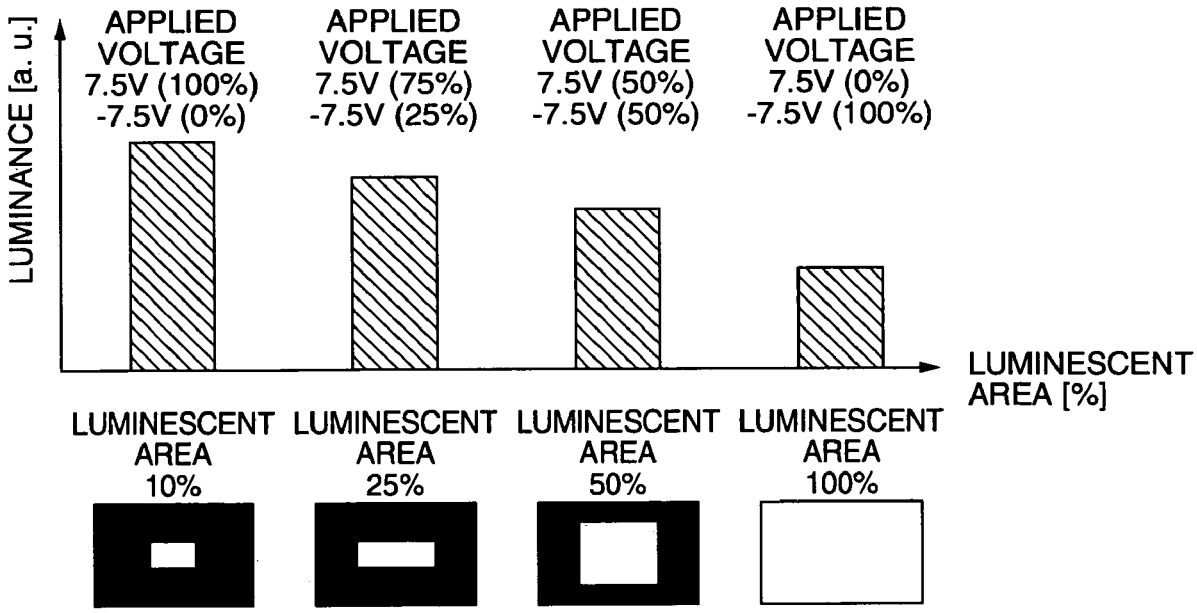
FIG. 10 is a diagram for explaining a specific example of a method of driving an organic EL device according to one embodiment of the invention.

FIG. 10 is a diagram for explaining a specific example of a method of driving an organic EL device according to one embodiment of the invention. Also in the graph of FIG. 10, luminescent areas of a light emitting element are plotted on the abscissa, while emission luminances of the light emitting element are plotted on the ordinate, similarly to FIG. 9. In addition, FIG. 10 schematically illustrates four relationships between the effective display region 4 and the luminescent area when the luminescent area is 10%, 25%, 50%, 100%, respectively.

As shown in FIG. 10, when the luminescent area is 10%, only a forward bias is applied but a reverse bias is not applied. That is, the duty ratio is set to 100%. In this example, the absolute values of applied forward and reverse bias voltages are equalized to each other for simplification of the configuration of the power supply control circuit SC. When the luminescent area is 25%, the application time periods of forward and reverse biases are set to 75% and 25%, respectively, and thus the duty ratio is set to 75%. When the luminescent area is 50%, both the application time periods of forward and reverse biases are set to 50%, and thus the duty ratio is set to 50%. When the luminescent area is 100%, only a reverse bias is applied but a forward bias is not applied. That is, the duty ratio is set to 0%. FIG. 10 illustrates only four conditions when the luminescent area is 10%, 25%, 50%, and 100%. However, it should be noted that continuous luminance control according to a luminescent area can be achieved by adequately setting the duty ratio depending on the luminance area.

The duty ratio between the forward and reverse biases is set based on the data stored in the LUT 17 shown in FIG. 1. According to the above-described setting and control, a luminance when the luminescent area is small can be set higher than one when the luminescent area is large, which allows luminance control according to a display area. In addition, the luminance control according to a luminescent area is allowed without changing the absolute value of an applied voltage between when a forward bias is applied and when a reverse bias is applied. Thus, the luminance control according to a luminescent area can be implemented without causing a rise of costs for the power supply control circuit SC. Furthermore, the application time periods of forward and reverse bias voltages can be varied only by changing the data stored in the table, which avoids a need to greatly change the device configuration.

It is preferable that the unit time period of application time periods of forward and reverse biases is the time period it takes for one frame to be displayed. If the time period of one frame is used as the unit time period, when the luminescent area is 50%, both the application time periods of forward and reverse biases are set to the time period it takes for 0.5 frames to be displayed. When the duty ratio takes a value other than 0% and 100%, at least one switch-over between forward and reverse biases is carried out within one frame. In terms of preventing flicker, it is preferable that the number of application times of each of forward and reverse biases is at least two within one frame.

In addition, when employing the bias application way in which forward and reverse biases are switched on a basis of one frame time period as the unit time period, one bias may be applied first prior to the other bias in each one frame. For example, a way is available in which invariably a forward bias is applied first in each one frame. Alternatively, another way is also available in which the bias applied first in a frame has the opposite polarity of that of the bias applied last in the previous frame. For example, a way is available in which when a forward bias is applied last in a frame, a reverse bias is applied first in the next frame. Although the above embodiment employs forward and reverse bias voltages having the same absolute value in terms of simplifying the device configuration, the absolute values thereof may be different from each other.

Figure 11:
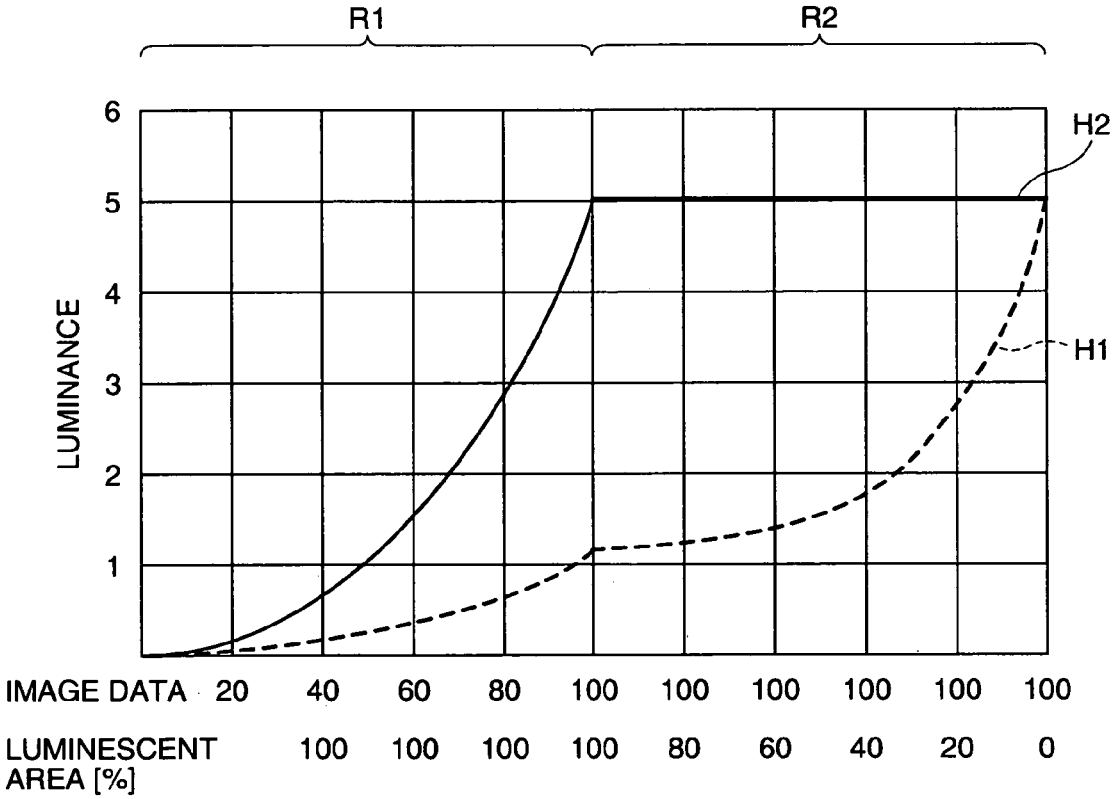
FIG. 11 is a diagram illustrating one example of luminance control in a CRT display and a liquid crystal display (LCD).

It is preferable that the luminance control according to a luminescent area is similar to luminance control in CRT displays. FIG. 11 is a diagram illustrating one example of luminance control in a CRT display and a liquid crystal display (LCD). In the graph of FIG. 11, image data and luminescent areas are plotted on the abscissa, while luminances are plotted on the ordinate. As for the image data on the abscissa, black displaying is implemented when the value is 0, while white displaying is implemented when the value is 100. The graph in FIG. 11 is divided into two graphs. Specifically, the graph is divided into a first graph R1 and a second graph R2. In the first graph R1, the value of the image data is changed within the range of 0 to 100 while fixing the luminance area at 100%. In the second graph R2, the luminance area is changed from 100% toward 0% while fixing the value of the image data at 100. The dashed line graph given numeral H1 indicates the luminance variation of the CRT display. The solid line graph given numeral H2 indicates the luminance variation of the LCD.

Referring to FIG. 11, in the first graph R1, both the graph H1 indicating the luminance variation of the CRT display and the graph H2 indicating the luminance variation of the LCD show a luminance increase associated with an increase of the image data value. However, in the second graph R2, the graph H1 indicating the luminance variation of the CRT display shows that the luminance increases nonlinearly as the luminescent area decreases, while the graph H2 indicating the luminance variation of the LCD shows that the luminance is kept constant at a certain value (the luminance when the image data value is 100). In related-art organic EL devices, luminance control according to a luminescent area is not implemented, and therefore light emission is carried out with a constant luminance invariably even when the luminescent area changes, like the LCD of which luminance variation is indicated by the graph H2.

In contrast, the organic EL device 1 of the present embodiment implements luminance control according to a luminescent area by employing the above-described driving method, and thus allows situation-appropriate sharp displaying like CRT displays. In order to achieve displaying that is extremely similar to that by CRT displays, it is preferable that the luminance control according to a luminescent area is implemented so that the luminance changes nonlinearly depending on the luminescent area like the graph H1, in the second graph R2, indicating the luminance variation of a CRT display.

Figure 12:
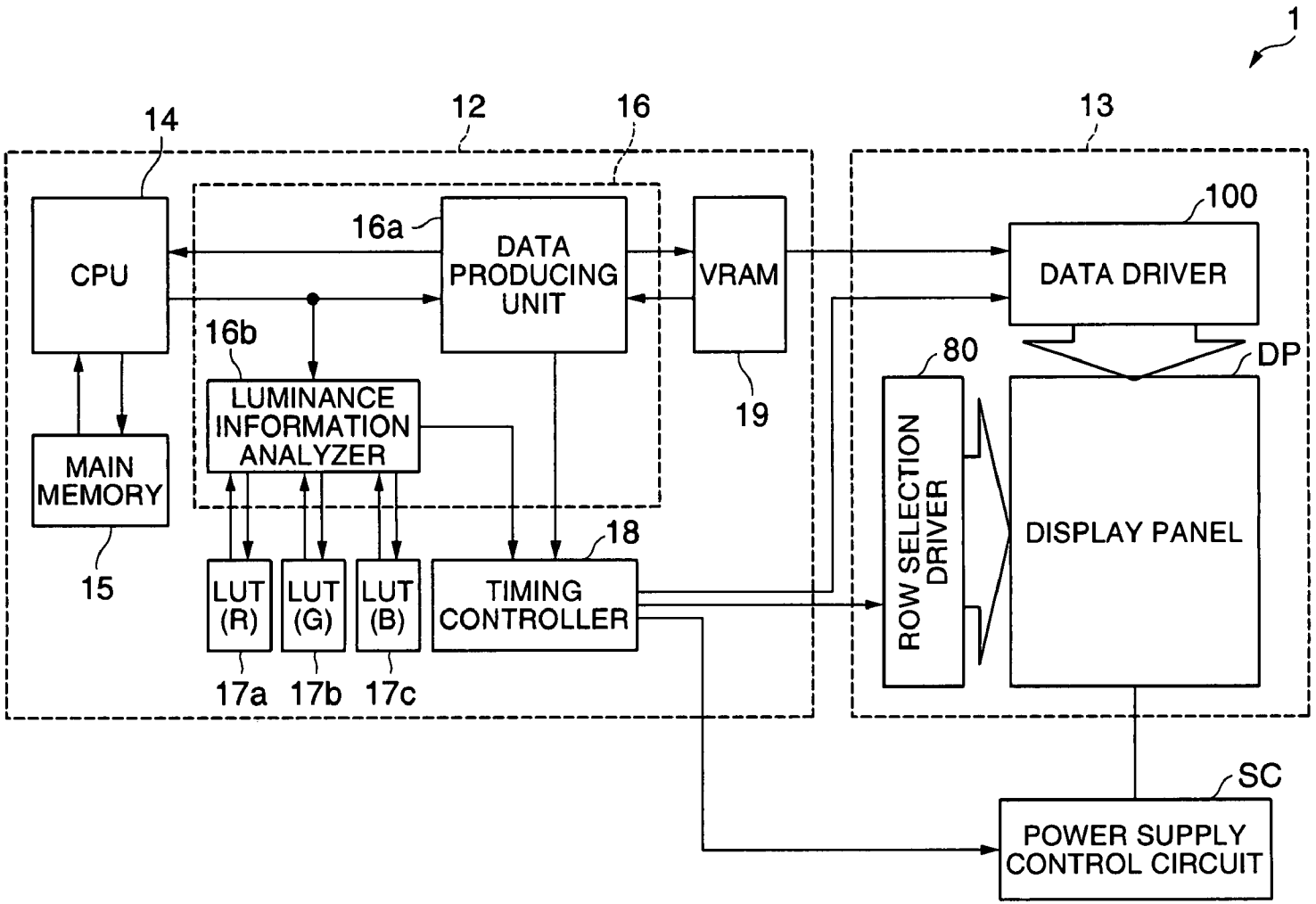
FIG. 12 is a block diagram illustrating the electrical configuration of an organic EL device according to another embodiment of the invention.

FIG. 12 is a block diagram illustrating the electrical configuration of an organic EL device according to another embodiment of the invention. The elements in FIG. 12 that are the same as or equivalent to those in FIG. 1 are given the same numerals. The organic EL device 1 in FIG. 12 is different from that in FIG. 1, in that the organic EL device 1 in FIG. 12 includes, instead of the LUT 17 in FIG. 1, three LUTs 17*a*, 17*b* and 17*c* for red light emitting elements, green light emitting elements and blue light emitting elements, respectively, and in that the configurations of the display panel DP and the power supply control circuit SC in FIG. 12 are different from those in FIG. 1.

The luminance information analyzer 16*b* of the graphic controller 16 calculates the luminance ratio of image data based on the image data output from the CPU 14. The luminance information analyzer 16*b* determines the ratio (duty ratio) between application time periods of a forward bias and a reverse bias that are supplied from the power supply control circuit SC to the display panel DP, based on the calculated luminance ratio of image data and the respective pieces of information stored in the LUTs 17*a*, 17*b* and 17*c*.

Figure 13:
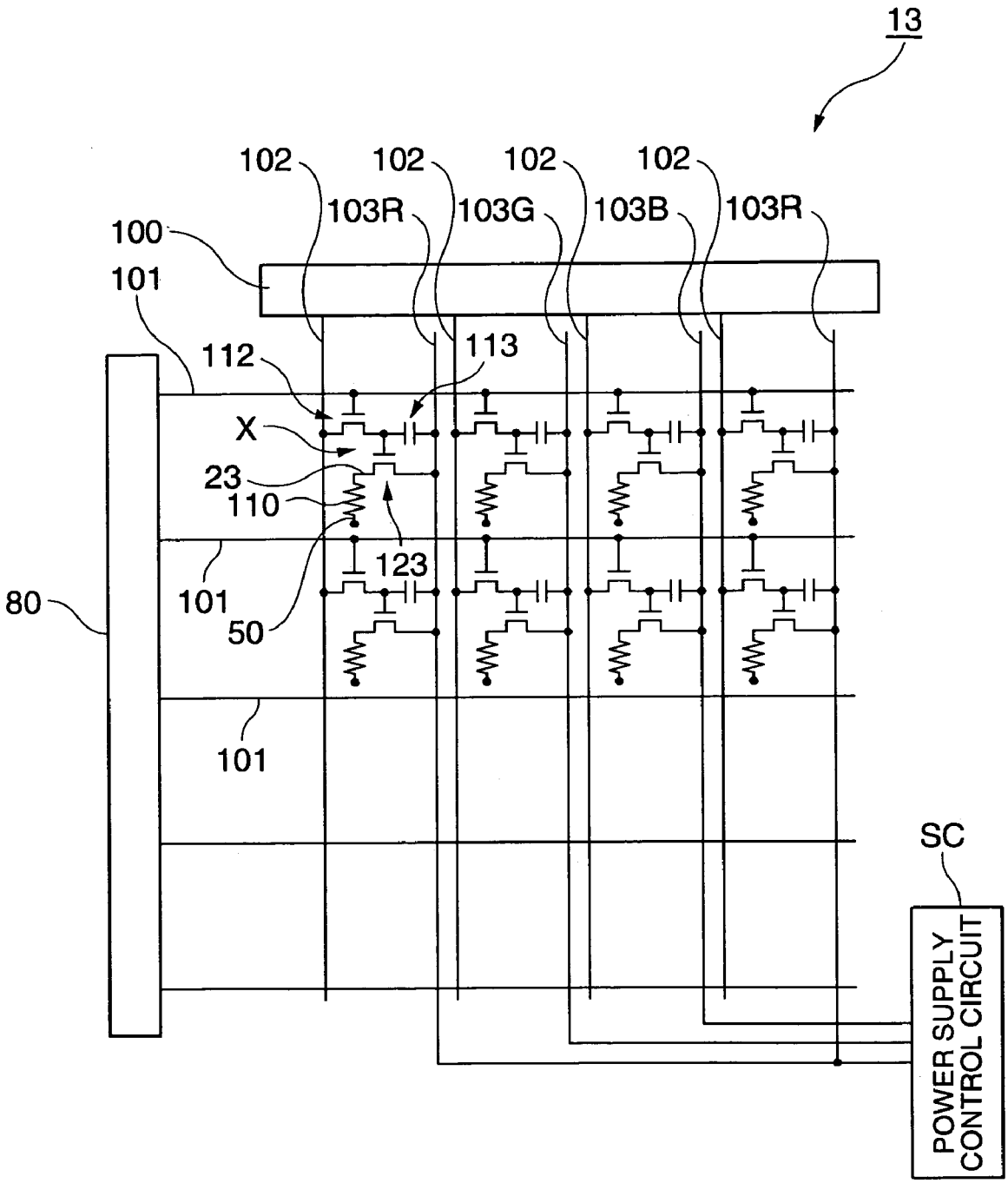
FIG. 13 is a schematic diagram illustrating the interconnect configuration of a display panel unit 13 provided in the organic EL device according to the another embodiment.

FIG. 13 is a schematic diagram illustrating the interconnect configuration of the display panel unit 13 provided in the organic EL device according to the another embodiment of the invention. The display panel unit 13 in FIG. 13 is different from that in FIG. 2, in that the display panel unit 13 in FIG. 13 includes, as a plurality of power supply lines extending in parallel with the signal lines 102, three kinds of power supply lines: power supply lines 103R for red light emitting elements, power supply lines 103G for green light emitting elements, and power supply lines 103B for blue light emitting elements. The power supply control circuit SC can apply forward and reverse biases to each of the power supply lines 103R, 103G and 103B, separately.

In the above-described configuration, the luminance information analyzer 16*b* provided in the graphic controller 16 in FIG. 12 calculates the luminance ratio of image data based on the image data output from the CPU14. The luminance information analyzer 16*b* then determines, for each of red, green and blue, the ratio (duty ratio) between application time periods of a forward bias and a reverse bias that are supplied from the power supply control circuit SC to the display panel DP, based on the calculated luminance ratio of image data and the respective pieces of information stored in the LUTs 17*a*, 17*b* and 17*c*. The graphic controller 16 outputs to the timing controller 18 the duty ratio determined by the luminance information analyzer 16*b* as well as the above-described synchronization signals.

Subsequently, the timing controller 18 outputs to the power supply control circuit SC, control signals for switching a bias between forward and reverse biases for each of red, green and blue. The power supply control circuit SC then applies, based on the control signals, forward and reverse biases to each of the power supply lines 103R, 103G and 103B separately. Thus, luminance control according to a luminescent area can be carried out for each of red, green and blue.

Also in this embodiment, it is preferable that the unit time period of application time periods of forward and reverse biases is the time period it takes for one frame to be displayed. In addition, it is preferable that the number of application times of each of forward and reverse biases is at least two within one frame. Moreover, when employing the bias application way in which forward and reverse biases are switched on a basis of one frame time period as the unit time period, one bias may be applied first prior to the other bias in each one frame. Alternatively, another way is also available in which the bias applied first in a frame has the opposite polarity of that of the bias applied last in the previous frame. Although the above embodiment employs forward and reverse bias voltages having the same absolute value in terms of simplifying the device configuration, the absolute values thereof may be different from each other. Furthermore, the absolute values may be different color by color.

Figure 14A:
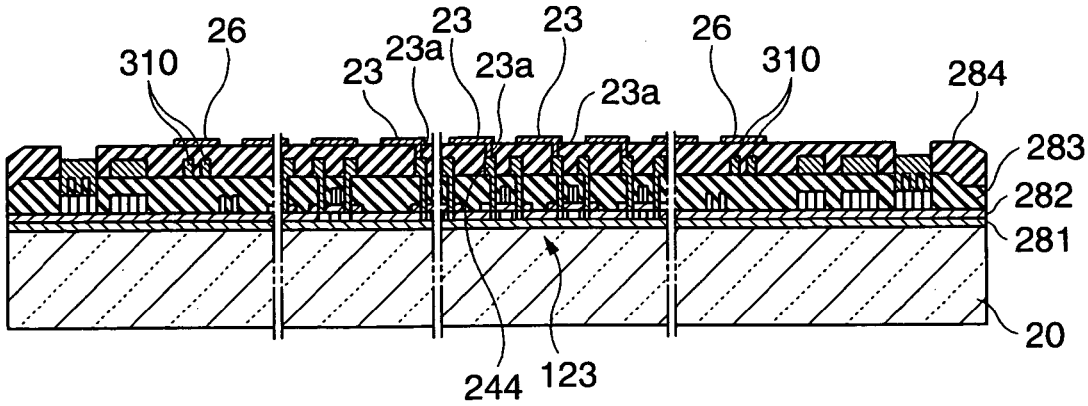
FIGS. 14A to 14C are sectional views illustrating manufacturing steps for the organic EL device 1 according to one embodiment of the invention.

A simple description will be made below about one example of a method of manufacturing the organic EL device 1 according to one embodiment of the invention. FIGS. 14A to 14C and 15A to 15C are sectional views illustrating manufacturing steps for the organic EL device 1 according to one embodiment of the invention. The sectional views of FIGS. 14A to 14C and 15A to 15C correspond to a sectional view along the line A-B in FIG. 3, and illustrate the organic EL device 1 in order of the manufacturing steps thereof. Referring first to FIG. 14A, the pixel electrodes 23 are formed on the circuit part 11 over the substrate 20. Specifically, a conductive film made of a conductive material such as ITO is initially deposited over the entire substrate 20. In this deposition, the conductive material is also provided in the contact holes 23*a* in the second interlayer insulating layer 284, to thereby form contacts. Subsequently, the conductive film is patterned to thereby form the pixel electrodes 23 so that the pixel electrodes 23 are coupled via the contacts to the drain electrodes 244 of the drive TFTs 123. Simultaneously with the forming of the pixel electrodes 23, dummy patterns 26 are also formed in dummy regions.

Note that not only the pixel electrodes 23 but also the dummy patterns 26 are illustrated as the pixel electrodes 23 for convenience in FIGS. 4 and 5. The dummy patterns 26 are formed into an island shape similarly to the pixel electrodes 23 formed in the effective display region, but are not coupled via the second interlayer insulating layer 284 to metal interconnects on a lower layer. It should be obvious that the dummy patterns 26 may have a shape different from that of the pixel electrodes 23 formed in the display region. In this configuration, the dummy patterns 26 also encompass patterns that are located at least above the drive voltage conductors 310 (340).

Figure 14B:
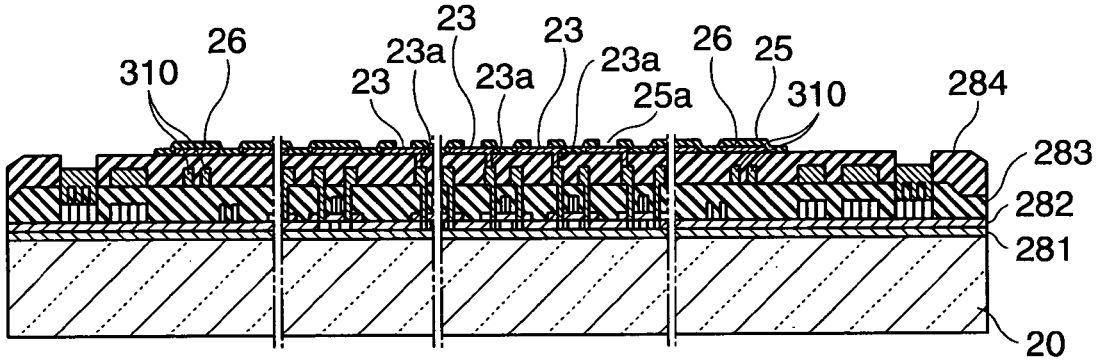

Referring next to FIG. 14B, the lyophilic control layers 25, which are an insulating layer, are formed on the pixel electrodes 23, the dummy patterns 26 and the second interlayer insulating layer 284. The lyophilic control layers 25 are formed so as to have an opening, in part thereof, on the pixel electrodes 23, which allows the movement of holes from the pixel electrodes 23 through the openings 25*a* (also see FIG. 4). Subsequently, BMs (not shown) are formed on the recesses of the lyophilic control layers 25, located between two pixel electrodes 23. Specifically, metal chromium is deposited on the recesses of the lyophilic control layers 25 by sputtering.

Figure 14C:
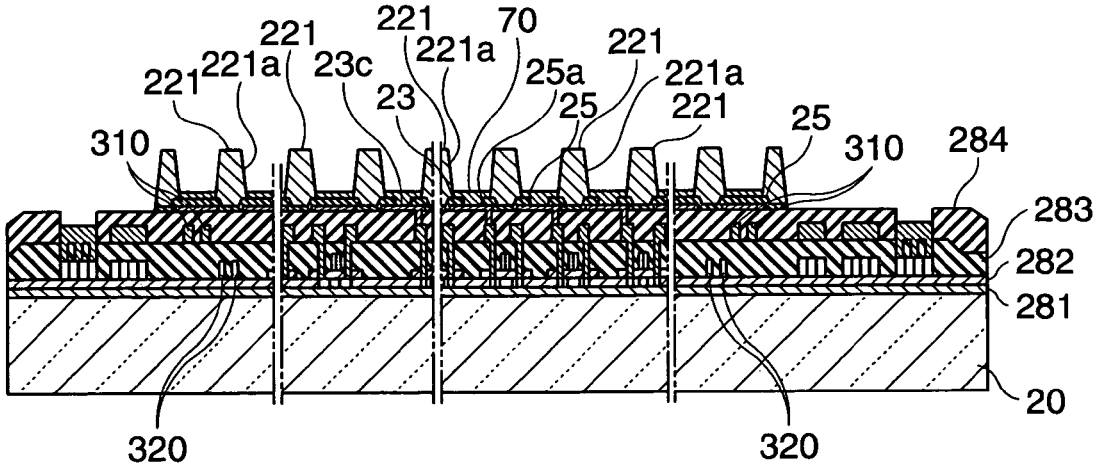

Referring next to FIG. 14C, the organic bank layers 221 are formed on certain positions on the lyophilic control layers 25, specifically, formed to cover the BMs. A specific forming method for the organic bank layers 221 is as follows. Specifically, a solution prepared by dissolving resist composed of e.g. an acrylic resin or polyimide resin in a solvent is applied by using any of various application methods such as spin coating and dip coating, to thereby form an organic substance layer. Any substance is available as the material of the organic substance layer as long as it is not dissolved by ink to be described later, and patterning therefor by use of etching or the like is easily carried out. The organic substance layer is then patterned by employing photolithography and etching so that bank openings 221*a* are formed in the organic substance layer, to thereby complete the organic bank layers 221 of which sidewall surfaces are exposed in the openings 221*a*. Note that the organic bank layers 221 encompass layers that are located at least above the drive control signal conductors 320.

Subsequently, lyophilic regions and lyophobic regions are formed in the surfaces of the organic bank layers 221, the lyophilic control layers 25, and the pixel electrodes 23. The present embodiment employs plasma treatment for forming the respective regions. The plasma treatment includes a preliminary heating step, a lyophilicity providing step, a lyophobicity providing step, and a cooling step that are carried out in that order. In the lyophilicity providing step, lyophilicity is provided for the top surfaces of the organic bank layers 221, the sidewall surfaces in the openings 221*a* thereof, electrode faces 23*c* of the pixel electrodes 23, and the top surfaces of the lyophilic control layers 25. Subsequently, in the lyophobicity providing step, of the surfaces that have been provide with lyophilicity, the top surfaces of the organic bank layers and the sidewall surfaces in the openings thereof are provided with lyophobicity.

Specifically, the base (the substrate 20 including the banks and so on) is initially heated at a certain temperature, e.g., at about 70-80° C., and then plasma treatment employing oxygen as a reaction gas under the atmospheric pressure (O2 plasma treatment) is carried out as the lyophilicity providing step. Subsequently, plasma treatment employing tetrafluoromethane as a reaction gas under the atmospheric pressure (CF4 plasma treatment) is carried out as the lyophobicity providing step. Thereafter, the base headed for the plasma treatment is cooled to a room temperature. In this manner, lyophilicity and lyophobicity are provided for certain regions.

This CF4 plasma treatment has a little effect also on the electrode faces 23*c* of the pixel electrodes 23 and the lyophilic control layers 25. However, ITO, which is the material of the pixel electrodes 23, and SiO2, TiO2 and the like, which are the material of the lyophilic control layers 25, have a low affinity for fluorine. Therefore, hydroxyl groups provided through the lyophilic providing step are not replaced by fluorine groups, which retains the lyophilicity thereof.

Subsequently, the anode buffer layers 70 are formed in an anode buffer layer forming step. In the anode buffer layer forming step, an ink jet method is preferably used in particular as a droplet discharge method. Specifically, a material for forming the anode buffer layers is selectively applied on the electrode faces 23*c* by the ink jet method. Drying treatment and heat treatment are then implemented to form the anode buffer layers 70 on the electrodes 23. Used as the material for forming the anode buffer layers 70 is a solution prepared by dissolving the above-described PEDOT/PSS in a polar solvent such as water or isopropyl alcohol.

The formation of the anode buffer layers 70 with use of the ink jet method is carried out as follows. Initially, the anode buffer layer forming material is loaded in an ink jet head (not shown). The ink jet head and the base (the substrate 20) are moved relative to each other, so that discharge nozzles of the ink jet head face the electrode faces 23*c* located in the openings 25*a* of the lyophilic control layers 25. Droplets are then discharged from the discharge nozzles to the electrode faces 23*c* while controlling the liquid volume per one droplet. Subsequently, the discharged droplets are dried to evaporate the dispersion medium and solvent contained in the anode buffer layer material, to thereby form the anode buffer layers 70.

In this formation, the droplets discharged from the discharge nozzles spread over the electrode faces 23*c* that have been provided with lyophilicity, and fill the openings 25*a* of the lyophilic control layers 25. In contrast, the top surfaces of the organic bank layers 221, provided with lyophobicity, repel the discharged droplets, and therefore no droplet is applied onto the top surfaces. Accordingly, even when a droplet erroneously lands on an unintended position and thus part of the droplet is brought into contact with the surface of the organic bank layer 221, the surface repels the droplet, which is then drawn into the opening 25*a* of the lyophilic control layer 25, without the surface getting wet with the droplet.

The baking temperature for the discharged material is preferably in the range of 100 to 200° C., and is more preferably about 120° C. This is because a temperature lower than 100° C. possibly cannot cure the forming material sufficiently, which leads to mixing of the insufficiently cured material with the emission layer forming material provided thereon. In addition, there is also a possibility that the contained solvent cannot be removed completely. In contrast, a temperature above 200° C. possibly causes transformation and deterioration of the forming material due to heat. It is preferable that steps subsequent to the anode buffer layer forming step are carried out in an inactive gas atmosphere such as a nitrogen atmosphere or argon atmosphere in order to prevent the various forming materials and formed elements from being oxidized and absorbing moisture.

Figure 15A:
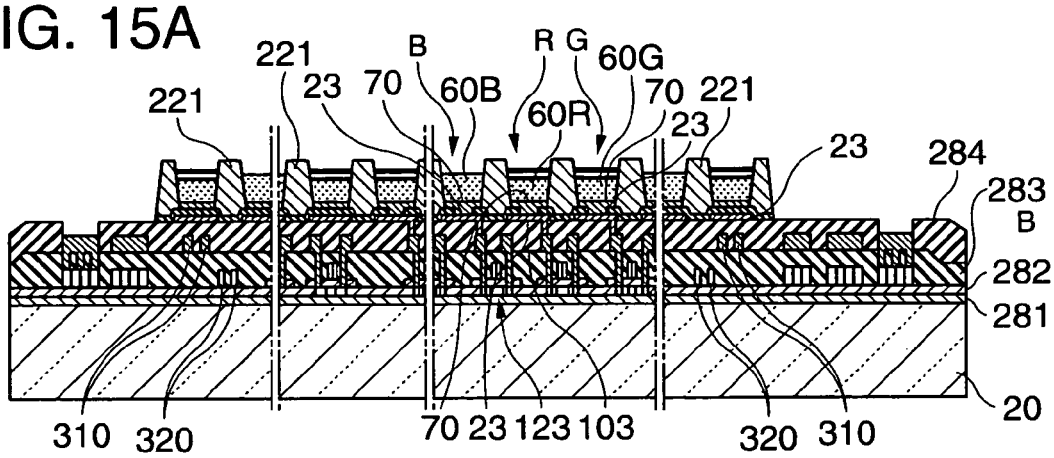
FIGS. 15A to 15C are sectional views illustrating manufacturing steps for the organic EL device 1 according to one embodiment of the invention.

Referring next to FIG. 15*a*, the emission layers 60 are formed in an emission layer forming step. In the emission layer forming step, an ink jet method is preferably used as a droplet discharge method similarly to the forming of the anode buffer layers 70. Specifically, an emission layer forming material is discharged on the anode buffer layers 70 by an ink jet method, and then drying treatment and heat treatment are carried out to thereby form the emission layers 60 in the openings 221*a* of the organic bank layers 221. The emission layers 60 are formed on each color basis. Use of an ink jet method (droplet discharge method) allows the material for forming the emission layers 60 to be selectively deposited only on certain positions, i.e., only on the pixel region. Furthermore, the discharge amount can be varied on each position basis. In addition, in the emission layer forming step, a nonpolar solvent that does not dissolve the anode buffer layers 70 is used as the solvent of the emission layer forming material in order to prevent redissolution of the anode buffer layers 70.

Figure 15B:
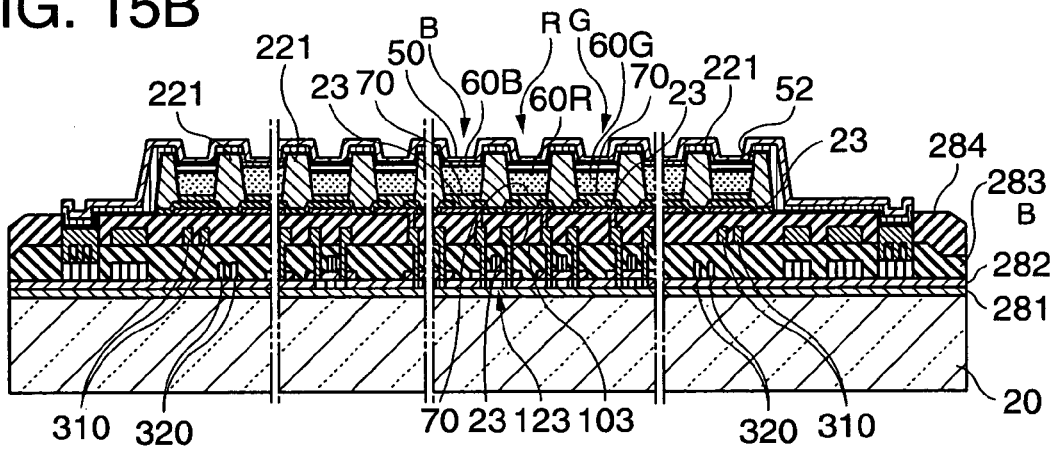

Referring next to FIG. 15*b*, the cathode buffer layer 52 is formed. In a forming step for the cathode buffer layer 52, the cathode buffer layer 52 is formed to cover the emission layers 60 and the organic bank layers 221. The forming of the cathode buffer layer 52 is carried out by applying a liquid material including the construction material of the cathode buffer layer 52. When employing the above-described PEDOT/PSS as the material for forming the cathode buffer layer 52, a solution is prepared by dispersing 3,4-polyethylenedioxythiophene in polystyrene sulfonate as a dispersion medium, and then dissolving the dispersion liquid in a polar medium such as water or isopropyl alcohol.

The use of a polar substance as the dispersion medium or solvent of the liquid material can prevent redissolution of the emission layers 60 in the applied liquid material. If exceptional dissolution of the emission layers 60 in a polar substance occurs, a nonpolar substance, such as toluene, xylene, benzene, hexane, cyclohexane, tetradecane, or isooctane, may be used as the dispersion medium or solvent.

The liquid material prepared as described above is applied on the surfaces of the emission layers 60 and the organic bank layers 221. Spin coating or the like may be used for the application of the liquid material, or alternatively an ink jet method may also be used similarly to the emission layers 60 and the anode buffer layers 70. Drying and baking of the applied liquid material completes the cathode buffer layer 52. The baking temperature for the cathode buffer layer 52 is preferably 150° C. or lower. This is because heat treatment at a temperature above 150° possibly deteriorates the functions of the emission layers 60, which are composed of organic substances. If PEDOT/IPSS is used as a conductive material in terms of this respect, baking at about 100° C. for about 10 minutes is allowed, which avoids damage on the emission layers 60.

Figure 15C:
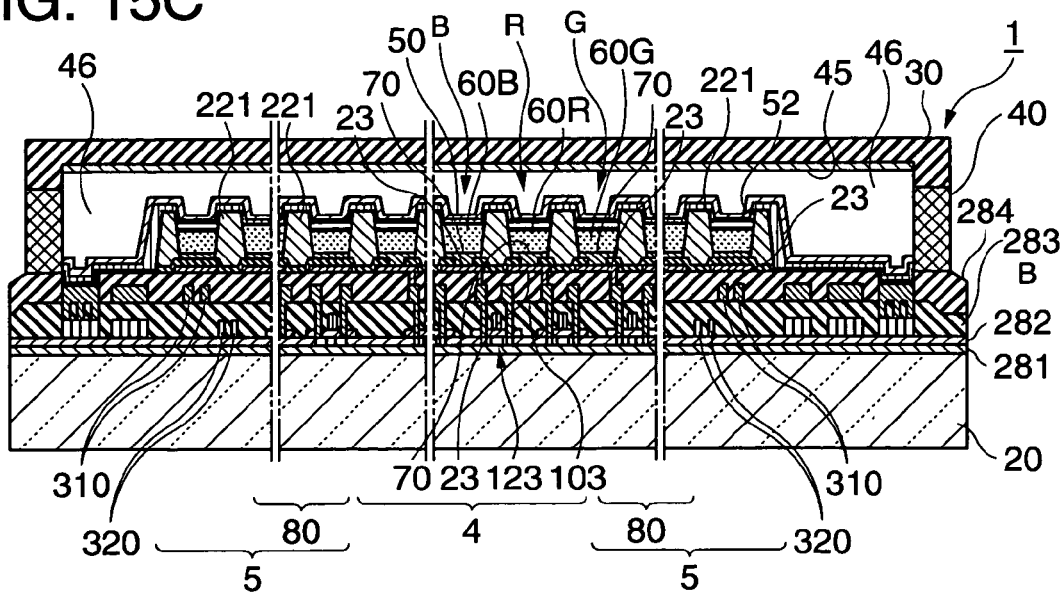

Subsequently, the common cathode 50 is formed. Although any material is available for the common cathode 50 as long as it is a conductive material that can be stably used in the air, it is preferable to use a material of which work function has a small difference from that of the anode material. When ITO is used as the anode, gold (Au) may be used as the cathode. Referring next to FIG. 15C, the surface of the substrate 20 is sealed by the sealing substrate 30. In the sealing step, the sealing substrate 30 having the getter agent 45 attached to the inside thereof is joined to the substrate 20 with the sealing resin 40. This sealing step is preferably carried out in an inactive gas atmosphere such as a nitrogen, argon, or helium gas atmosphere. Thus, the space surrounded by the substrate 20, the sealing substrate 30, and the sealing resin 40 is hermetically filled with an inactive gas. Through the above-described steps, the organic EL device 1 according to one embodiment of the invention is completed.

As described above in detail, in the organic EL device 1 according to one embodiment and the manufacturing method thereof, the anode buffer layers 70 and the cathode buffer layer 52 are formed of conductive polymers. This configuration allows light emitting elements to emit light invariably both when a forward bias is applied thereto, and when a reverse bias, of which polarity is opposite to that of the forward bias, is applied thereto. This alternate bias application alleviates the accumulation of charges and impurity ions inside the light emitting element and an internal electric field generated due to the impurity ions. Furthermore, the light emission in response to both the biases permits displaying without shortening effective emission time periods. Since the application time periods of forward and reverse bias voltages that offer different emission characteristics are set according to a luminance ratio, luminescent control according to a luminance ratio can be inplementede. In addition, if forward and reverse biases having different voltage values are applied to light emitting elements, flicker can be prevented even when the emission characteristic of the light emitting elements obtained when the forward bias is applied thereto is different from that when the reverse bias is applied thereto.

Figure 16A:
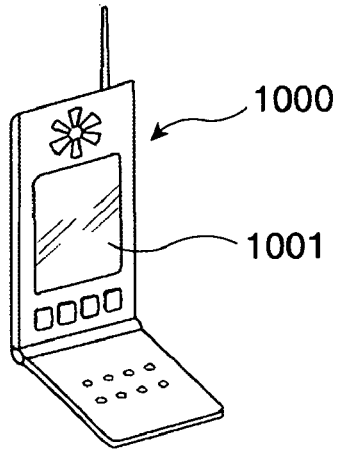
FIGS. 16A to 16C are diagrams illustrating examples of electronic apparatuses according to one embodiment of the invention.
Figure 16B:
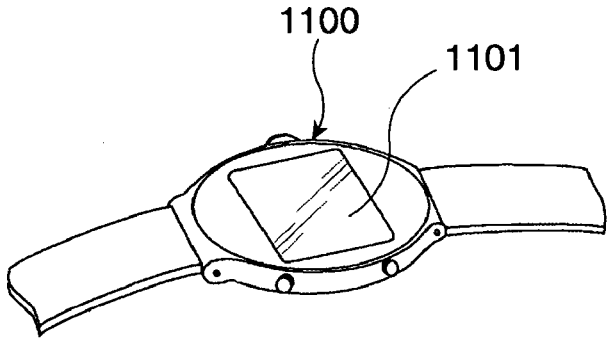
Figure 16C:
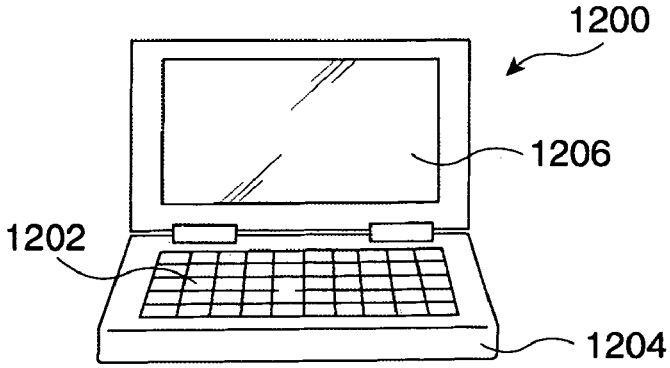

Electronic apparatuses according to one embodiment of the invention will be described below. The electronic apparatuses according to one embodiment include for its display unit the above-described organic EL device 1. FIGS. 16A to 16C illustrate specific examples of the apparatuses. FIG. 16A is a perspective view illustrating one example of cellular phones. Referring to FIG. 16A, a cellular phone 1000 includes a display unit 1001 employing the organic EL device 1. FIG. 16B is a perspective view illustrating one example of watch electronic apparatuses. Referring to FIG. 16B, a watch 1100 includes a display unit 1101 employing the organic EL device 1. FIG. 16C is a perspective view illustrating one example of portable information processing devices typified by word processors and personal computers. Referring to FIG. 16C, a information processing device 1200 includes an input unit 1202 such as a keyboard, a display unit 1206 employing the organic EL device 1, and a main body (box and cover) 1204. Since the electronic apparatuses shown in FIGS.

16A to 16C include the display units 1001, 1101 and 1206, respectively, employing the organic EL device 1, the electronic apparatuses can have a favorable displaying characteristic.

What is claimed is:

1. An organic electro-luminescence (EL) device including at least an emission layer between an anode and a cathode that are opposed to each other, comprising:

an anode buffer layer that is composed of an electrically conductive material and is provided between the anode and the emission layer;

a cathode buffer layer that is composed of an electrically conductive material and is provided between the cathode and the emission layer; and a drive unit that applies a forward bias voltage and a reverse bias voltage to the anode and the cathode with setting application time periods of the forward bias voltage and the reverse bias voltage according to a luminance ratio of an image to be displayed, the drive unit applying each of the forward bias voltage and the reverse bias voltage to the anode and the cathode at least twice per a unit time period, and the drive unit applying first, in each unit time period, a bias voltage of which polarity is opposite to a polarity of a bias voltage applied last in the previous unit time period.

2. The organic EL device according to claim 1, the unit time period being a time period during which one frame of the image is displayed.

3. The organic EL device according to claim 1, the drive unit applying first, in each unit time period, one of the forward bias voltage and the reverse bias voltage prior to the other thereof.

4. The organic EL device according to claim 1, the drive unit setting application time periods of the forward bias voltage and the reverse bias voltage so that emission luminance of the emission layer shows a nonlinear dependence on the luminance ratio of the image to be displayed.

5. The organic EL device according to claim 4, the drive unit including a table for defining application time periods of the forward bias voltage and the reverse bias voltage depending on the luminance ratio of the image to be displayed, the drive unit setting application time periods of the forward bias voltage and the reverse bias voltage based on the table.

6. The organic EL device according to claim 1, the emission layer including a red emission layer that emits red light, a green emission layer that emits green light, and a blue emission layer that emits blue light; and the drive unit setting application time periods of the forward bias voltage and the reverse bias voltage for each of the red emission layer, the green emission layer and the blue emission layer.

7. The organic EL device according to claim 1, the anode buffer layer and the cathode buffer layer being composed of an electrically conductive polymer.

8. The organic EL device according to claim 1, the anode buffer layer and the cathode buffer layer being composed of a polymer compound including ethylenedioxythiophene.

9. The organic EL device according to claim 1, the anode buffer layer and the cathode buffer layer being composed of PEDOT/PSS.

10. The organic EL device according to claim 1, a sheet resistance of the anode buffer layer and a sheet resistance of the cathode buffer layer being smaller than 100 Ωcm.

11. An electronic apparatus comprising the organic EL device according to claim 1.

12. The organic EL device according to claim 1, the forward bias voltage and the reverse bias voltage having opposite polarities.

13. A method of driving an organic electro-luminescence (EL) device including at least an emission layer between an anode and a cathode that are opposed to each other, the method comprising:

providing an anode buffer layer composed of an electrically conductive material between the anode and the emission layer;

providing a cathode buffer layer composed of an electrically conductive material between the cathode and the emission layer; and applying a forward bias voltage and a reverse bias voltage to the anode and the cathode with setting application time periods of the forward bias voltage and the reverse bias voltage according to a luminance ratio of an image to be displayed, each of the forward bias voltage and the reverse bias voltage being applied to the anode and the cathode at least twice per a unit time period, and a bias voltage being applied first in each unit time period, the bias voltage having a polarity opposite to a polarity of a bias voltage applied last in the previous unit time period.

14. The method of driving an organic EL device according to claim 13, the unit time period being a time period during which one frame of the image is displayed.

15. The method of driving an organic EL device according to claim 13, one of the forward bias voltage and the reverse bias voltage being applied first prior to the other thereof in each unit time period.

16. The method of driving an organic EL device according to claim 13, application time periods of the forward bias voltage and the reverse bias voltage being set so that emission luminance of the emission layer shows a nonlinear dependence on the luminance ratio of the image to be displayed.

17. The method of driving an organic EL device according to claim 16, application time periods of the forward bias voltage and the reverse bias voltage being set based on a table for defining application time periods of the forward bias voltage and the reverse bias voltage depending on the luminance ratio of the image to be displayed.

18. The method of driving an organic EL device according to claim 13, the emission layer including a red emission layer that emits red light, a green emission layer that emits green light, and a blue emission layer that emits blue light; and application time periods of the forward bias voltage and the reverse bias voltage being set for each of the red emission layer, the green emission layer and the blue emission layer.

19. The method of driving an organic EL device according to claim 13, the forward bias voltage and the reverse bias voltage having opposite polarities.

* * * * *